US005161593A

United States Patent [19]

Hirabayashi et al.

[11] Patent Number: 5,161,593

[45] Date of Patent: Nov. 10, 1992

[54] SHUTTER ASSEMBLY FOR A BAY WINDOW

[75] Inventors: Hideo Hirabayashi; Yoshitsugu Utsumi; Masakazu Makino; Hirosaburou Mori, all of Tokyo, Japan

[73] Assignee: Sanwa Shutter Corporation, Tokyo, Japan

[21] Appl. No.: 521,710

[22] Filed: May 9, 1990

[30] Foreign Application Priority Data

| | | | |
|---|---|---|---|
| Jan. 22, 1990 | [JP] | Japan | 2-12131 |
| Jan. 22, 1990 | [JP] | Japan | 2-12132 |
| Jan. 22, 1990 | [JP] | Japan | 2-12133 |
| Jan. 22, 1990 | [JP] | Japan | 2-12134 |
| Jan. 22, 1990 | [JP] | Japan | 2-12135 |
| Jan. 22, 1990 | [JP] | Japan | 2-12136 |
| Jan. 22, 1990 | [JP] | Japan | 2-12137 |
| Jan. 22, 1990 | [JP] | Japan | 2-12138 |
| Jan. 22, 1990 | [JP] | Japan | 2-12139 |
| Jan. 22, 1990 | [JP] | Japan | 2-12140 |
| Jan. 22, 1990 | [JP] | Japan | 2-12141 |
| Jan. 22, 1990 | [JP] | Japan | 2-12142 |
| Jan. 22, 1990 | [JP] | Japan | 2-12143 |
| Mar. 22, 1990 | [JP] | Japan | 2-72590 |
| Mar. 26, 1990 | [JP] | Japan | 2-30728 |

[51] Int. Cl.[5] ..... E06B 9/08

[52] U.S. Cl. ..... 160/120; 160/26; 160/133; 160/241; 160/270; 160/310; 160/315; 160/319

[58] Field of Search ..... 160/120, 26, 114, 133, 160/265, 310, 311, 319, 132, 88, 178.3, 266, 270, 271, 241, 315

[56] References Cited

U.S. PATENT DOCUMENTS

| | | | |
|---|---|---|---|
| 642,423 | 1/1900 | Brodie | 160/120 |
| 854,963 | 5/1907 | Osborn | 160/26 X |
| 1,314,221 | 8/1919 | Schenck | 160/271 X |
| 1,894,833 | 1/1933 | Ruby et al. | 160/310 X |
| 2,341,123 | 2/1944 | Schweller | 160/120 X |
| 3,853,168 | 12/1974 | Wrono . | |
| 4,601,320 | 7/1986 | Taylor | 160/271 |

FOREIGN PATENT DOCUMENTS

| | | | |
|---|---|---|---|
| 533864 | of 0000 | Australia . | |
| 0317461 | of 0000 | European Pat. Off. . | |
| 0211660 | 2/1987 | European Pat. Off. . | |
| 0320423 | 7/1988 | European Pat. Off. . | |
| 203397 | 3/1906 | Fed. Rep. of Germany . | |
| 1811271 | of 0000 | Fed. Rep. of Germany . | |
| 3240101 | 3/1984 | Fed. Rep. of Germany . | |
| 258187 | of 1928 | Italy | 160/133 |
| 455231 | of 0000 | Switzerland . | |
| 8462 | of 1913 | United Kingdom . | |
| 923177 | of 1963 | United Kingdom | 160/26 |
| 2109848A | of 1982 | United Kingdom | 160/26 |
| 8500633 | 2/1985 | World Int. Prop. O. . | |

*Primary Examiner*—Carl D. Friedman
*Assistant Examiner*—Derek J. Berger
*Attorney, Agent, or Firm*—Ladas & Parry

[57] ABSTRACT

A shutter assembly for a bay window to close an opening by moving a shutter curtain upward from a containing space in the bottom of the bay window and to open it by way of a downward movement of the curtain under the influence of a coil spring. The basic driving system for the shutter is located either in the roof or in the lower containing space of the bay window. Various devices are disclosed including a seal for sealing the space between the leading member of the curtain and the roof of the bay window, a structure for installing the driving motor, a structure for detachable connection of the driving shaft, hainging members used to raise and lower the curtain, a structure for supporting the winding drum on the driving shaft, as well as features to allow maintenance of the shutter assembly.

15 Claims, 19 Drawing Sheets

SHUTTER ASSEMBLY FOR A BAY WINDOW

FIELD OF THE INVENTION

The present invention relates to a shutter assembly installed or to be installed on the outside of a bay window, and more specifically to a shutter capable of opening and closing the bay window with its shutter curtain wound and stored by downward winding into a lower part of the bay window and to be extended by upward lifting to close the window opening.

DESCRIPTION OF THE PRIOR ART

Recently, the bay windows as an assembly, formed into a unit of metal product on the outside of a building is increasing. One form of these is a 3-sided bay window composed of a front window and 2 side windows connected in right angle or diagonally, and another form is a 2-sided bay window with its side windows connected in the front.

As these windows are installed on the outside of a building, they require means to protect against weather and crime, and an ordinary shutter therefor require an independent assembly of a shutter frame composed of an upper frame to support a driving system to wind and unwind a shutter curtain, a pair of guide rails therefor and a lower frame, resulting in double installation in front and around the window sash frame.

A combined, product of a bay window assembly with its shutter frame in front of a sash frame is conceivable, but such first problem encountered in the shutter products lie in that, when all components of driving system such as a winding shaft for a shutter curtain and driving motor are contained in a shutter case or directly in a roof space of the assembly, the roof part becomes extraordinarily large and jambs of the window must be large and strong enough to support the roof, resulting in heavy construction of the assembly and a detracting appearance of the bay window.

The second porblem relates also to the formation of jamb members with guide rails for the shutter. In the case of ordinary flat windows, guide rails can be installed on both side of an opening, but in the case of a bay window having 3 or 2 sides of window sashes, the shutter must be guided along a jamb interposed at the corner, and the jamb requires a much broader width than is required for a center posed of a multi-sided shutter, which reduces the effective window opening.

Moreover, in order to connect the winding shaft and the driving shaft of the motor coaxially, the angle at the corner must be less than 40° for a conventional joint. Altough joined means for 90° connections are available, they require more connecting space in the jamb, making the wider front width of the jamb affecting directly on its appearance.

The third problem lies in the manner of operating the shutter itself. Prior art shutters in the form of a light construction of a system with a shutter curtain capable of closing an window aperture by lifting up manually from a container provided on the outside of the window and opening by winding down into the container are disclosed in the laid-open bulletins for applications of Utility Model No. Heisei 1-138098 and No. Showa 55-165904 in Japan. With these inventions, the container of the shutter curtain should project into inside of a room, or, when applied for a bay window, the container must project below the window resulting in not only being unpractical and detracking from the appearance of the window, but having no intermediate means of operation between full-opening and full-closing. Therefore, with an operation of a shutter by an ordinary electric driving system for a bay window, no specific opening and closing system suitable for a lift-closing type shutter has been presented.

The object of the present invention lies in presenting a novel bay window assembly to eliminate the disadvantages of the prior art generally and to conform requirements for a combined shutter and a window as a complete product by applying a system of upward lifting of a shutter curtain, and accordingly, providing various practical means of realizing the system, including the arrangement of the components as well as formations corresponding to its operation.

Another object of the present invention is, in a combined bay window and a shutter, by an improvement of means of providing guide rails with jambs located at the corners of the window, installing of the shutter curtain to the guide rails eliminates the necessity of very complicated assembling procedures and difficult dismantling of the rail for maintenance or exchange.

A further object of the present is, in a combined bay window and a shutter, the new shutter curtain is operated up and down by a positive driving mechanism, instead of utilizing its weight or biasing force during its vertical movement to simplify and eliminate coil springs in the winding shaft.

DISCLOSURE OF THE INVENTION

The basic feature of the present invention lies in the, shutter assembly for a bay window comprising a shutter curtain to be wound around a winding shaft contained in a lower containing space formed in a bay window, a driving system consisting of a pair of winding drums supported on each end of a driving shaft and connected to a driving motor operable in a winding and unwinding direction, and a pair of hanging members connected at one end to said winding drums and at another end to ends of leading member of the shutter curtain, and a pair of guide rails fixed on jambs dividing surfaces of the bay window at its corner to guide the ends of the shutter curtain and is characterized in that said driving system is disposed in the roof space of the bay window in order to close the shutter curtain by upward operation of the driving motor and to open the curtain by reverse operation of the motor and downward winding of the winding shaft biased by the coil spring therein.

By providing the construction set forth above with various technical aspects, a novel shutter assembly for a bay window of a lift-up system can be accomplished.

In the shutter assembly of the present invention, various new compositions are applied. Firstly, a winding shaft to wind a shutter curtain, a driving shaft to support the winding drums, a hanging member to operate the shutter curtain, and relations between them in their connections are illustrated.

The first formation is shown as a means of connecting the driving motor to deliver its output to the driving shaft by a form of universal joint at the corner of the bay window. The second formation shows intersecting disposition of the winding shafts at the corners of the bay window with their ends one above the other. In the third formation, the axis of the driving shaft to support the winding drums is located the parallel to and on outer side of the vertical plane including the winding shaft to wind up the shutter curtain delivered outward from the winding shaft on the inner side of the winding drum. The fourth formation shows connecting construction of the hanging member to the winding drum in which the member is a steel belt and the cylindrical winding drum is divided into two parts to hold the end of the belt tightly in between. The major part provides a fixing area formed by a central flat portion with means of holding the belt and sloping side portions to mate with the belt. The minor part provides a counter part of the former to be fixed thereon with a screw.

The second aspect of the present invention is directed to the contacting of the leading member of the shutter curtain to the bottom member of the roof to prevent a possible diagonal gap by means of a sealing device provided with cushion members on at least one of the closing parts, corresponding to full contact between the bottom slat member of the curtain and the floor surface as in case of an ordinary shutter.

Also corresponding to the conventional shutter case, on the upper surface of the lower containg space, a passage slit for the shutter curtain is provided and a pair of guide pieces are provided along the slit with their tips spaced apart wider downward to guide the shutter curtain, while the slit is covered by a plate formed on the top of the leading member of the curtain.

The third aspect of the shutter assembly according to the present invention is directed to the driving system contained in the roof space. The first formation shows that the driving motor is installed on an supporting seat provided on a upper frame of the bay window, and by means of a fixing plate fixed on the inner side of the motor, and by fixing the lower flange of the plate only cnto the supporting seat with screws, the motor is installed detachably in the roof. The second formation is shown as a connecting device of the shaft of driving motor and the shaft of winding drum of the shutter curtain, which consists of a connecting shaft with a joint bar slidable therein and detachable from the motor to enable easy maintenance arround the motor and the winding drum. The third formation shows the winding drum enclosed within a housing case as a supporting member of the driving shaft, and each of the cases includes regulating pins to regulate winding of the belt thereon. Also, means of access apertures with a door or a cover are provided for the maintenance of the driving system.

The fourth aspect of a bay window, although not limited to the shutter assembly according to the present invention, relates generally to construction of guide rails. The guide rail consists of two symmetric members of a section of a shape of L with a longer side wall and a shorter end wall engaged together with their end wall connected detachably to form a normal guiding groove for guiding vertically the shutter curtain. One member is formed in the outer front corner as a part of a jamb member in a form of a longitudinal recess and the other member is a separate guide rail member formed as the counter part member in the guide rail to be engaged with the former. On the end plate of the latter, a plurality of cutouts in a row of receiving parts is formed, and on the corresponding parts of the end plate in the jamb, a row of engaging members are provided to be engaged with the receiving parts to combine the two members into a guide rail, the detachable construction of which improves the essential assembling and disassembling problem due to the length of the shutter curtain over the width of the opening.

For the new construction of the guide rail, in the same principle, the engaging means can be modified to use a coupling device for both of the end walls.

The shutter assembly according to the second invention shows a further development of the driving system. The invention discloses a type of a shutter for a bay window with a driving system to positively drive the shutter curtain in both direction of upward closing and downward opening along the guide rail. The system is characterized in that main parts of the driving system such as a driving motor, winding shafts, driving shafts are also disposed in the lower containing space of a bay window in order to close and open the shutter curtain positively by upward and downward operation of the driving motor while an intermediate roller for the belt only is disposed in the roof space. This eliminates the biasing coil spring in the winding shaft and enables the roof part above to be of lighter and of smaller construction.

The other features of the present invention are understood by the following non-limitating embodiments shown in the following drawings.

BRIEF DESCRIPTION OF THE DRAWINGS

From FIG. 1 through FIG. 5 illustrate external perspective views of a combined shutter and a window of the present invention.

FIG. 6 is a side view of the hanging member;

FIG. 7 is its front view;

FIGS. 8 and 9 are exploded partial view of each part;

FIG. 10 is a perspective view of upper part of the shutter curtain;

FIG. 11 is a vertical sectional view of the shutter curtain;

FIG. 12 is a cross-sectional view of the leading member;

FIG. 13 is a front view of the leading member;

FIG. 14 is a cross-sectional view of the sealing device;

FIG. 15 is an enlarged detail of the main part thereof;

FIG. 16 is a cross-sectional view of other embodiment of the sealing device with a cushion member;

FIG. 18 is a side view of the motor;

FIG. 19 is a side view of its supporting seat;

FIG. 20 is a plan view of the seat plate;

FIG. 21 is a side view of the fixing plate;

FIG. 22 is a front view of the plate;

FIG. 32 is a plan view of the jamb;

FIG. 33 is a cross section of the guide rail member;

FIG. 34 is a front view of the guide rail member;

FIG. 35 is its side view;

FIG. 36 is a plan view of the jamb;

FIG. 37 is a exploded plan view corresponding to the FIG. 36;

FIG. 38 is a perspective view showing the assembling of the guide rail;

FIG. 39 is a general vertical cross-sectional view of a bay window;

FIG. 40 is a perspective view of the driving system;

FIG. 41 is a perspective view of the driving system.

BEST MODE OF CARRYING OUT THE INVENTION

Figure 1:
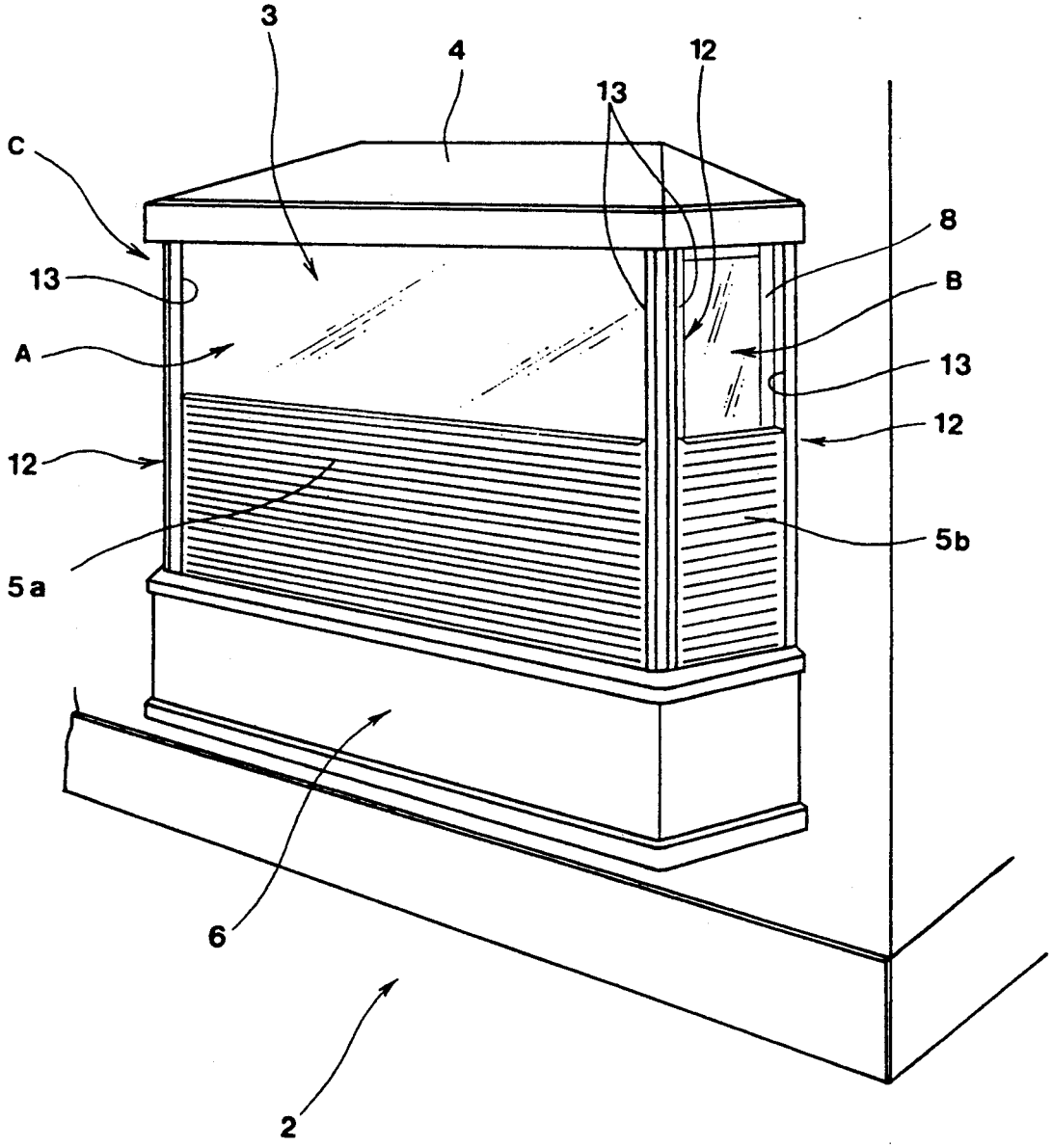
FIG. 1 is a general perspective view of a bay window.
Figure 2:
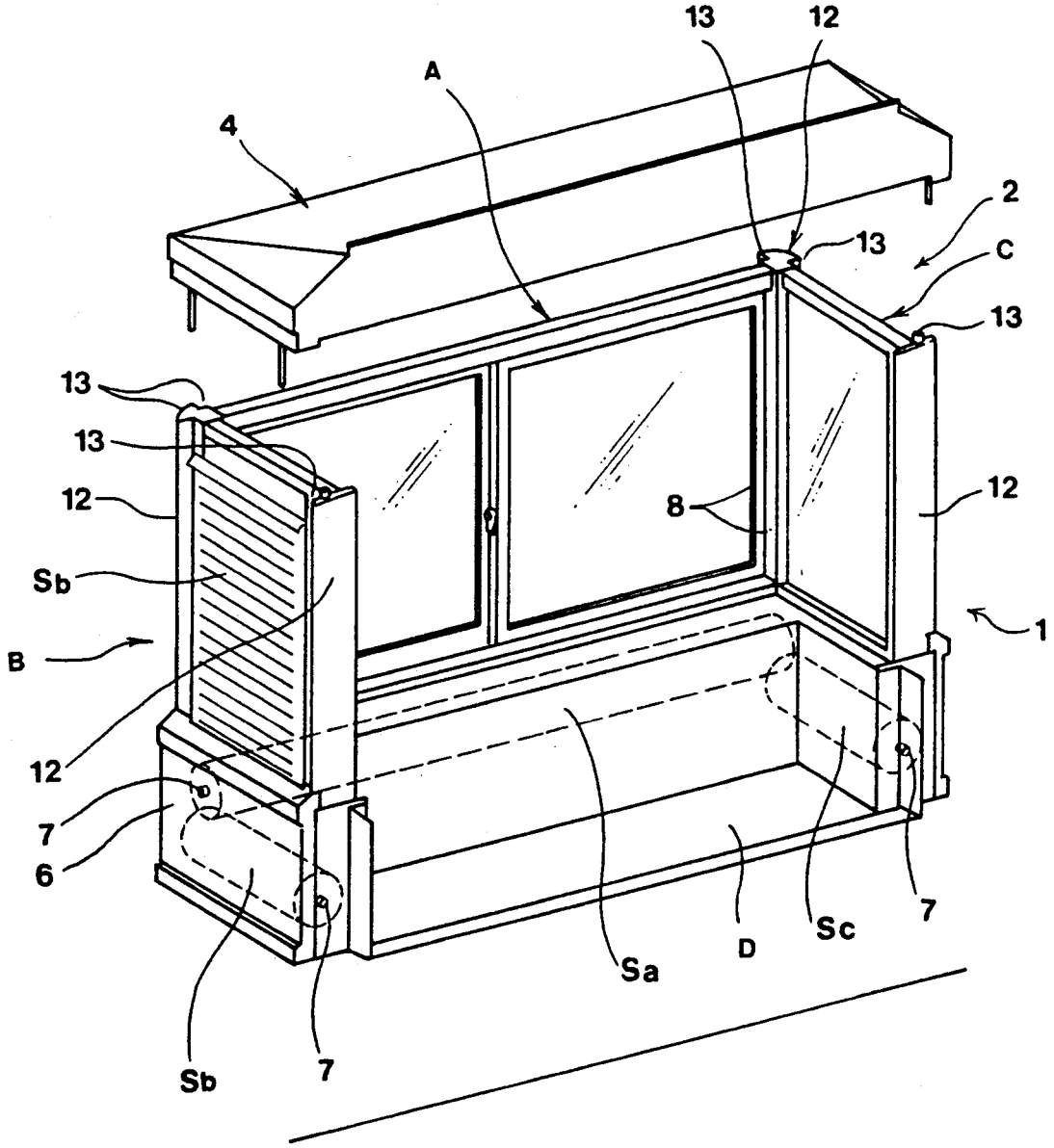
FIG. 2 is a inside view of a bay window with its side windows in right angle to the front window.
Figure 3:
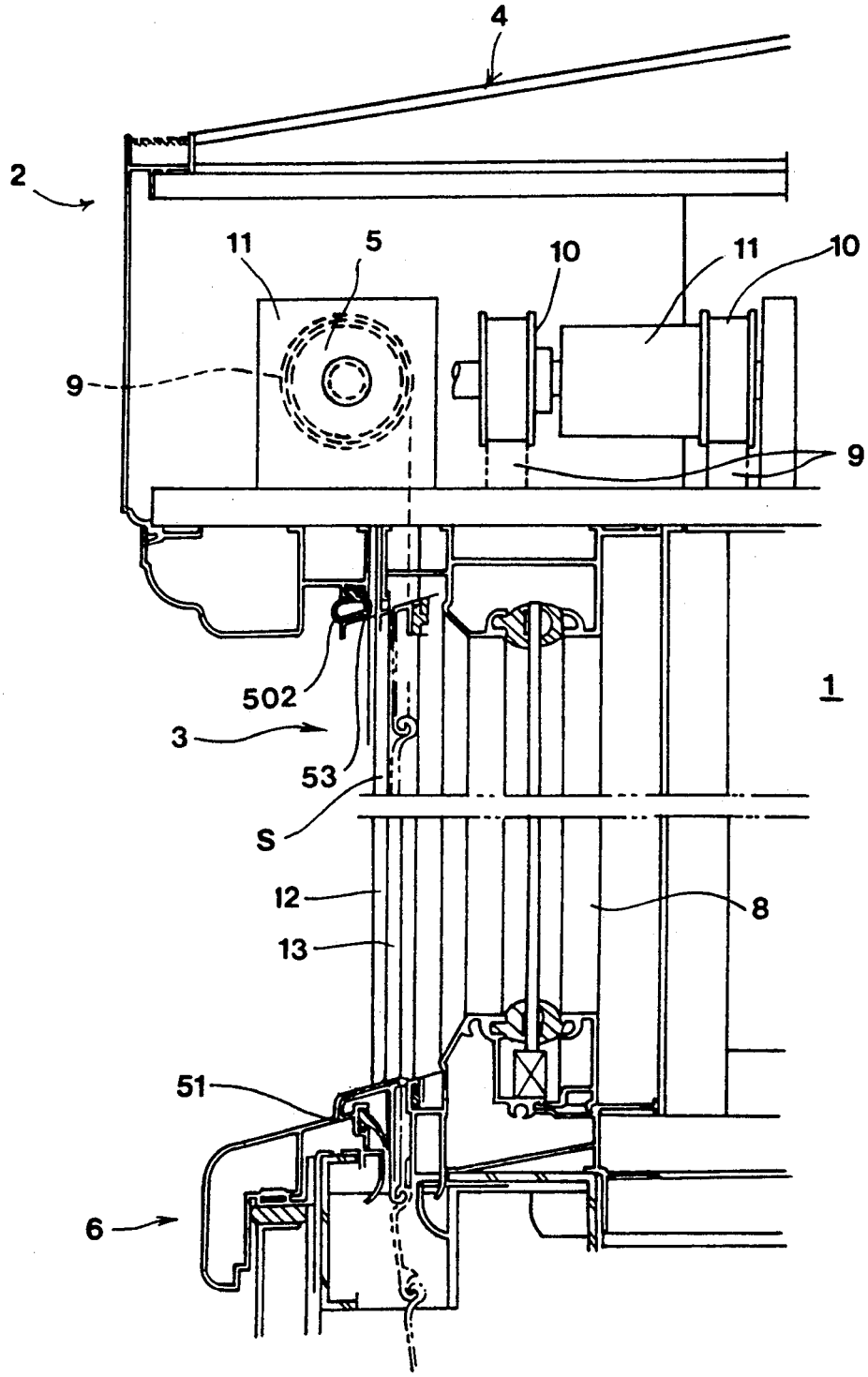
FIG. 3 is a standard vertical cross-sectional view of the bay window.
Figure 4:
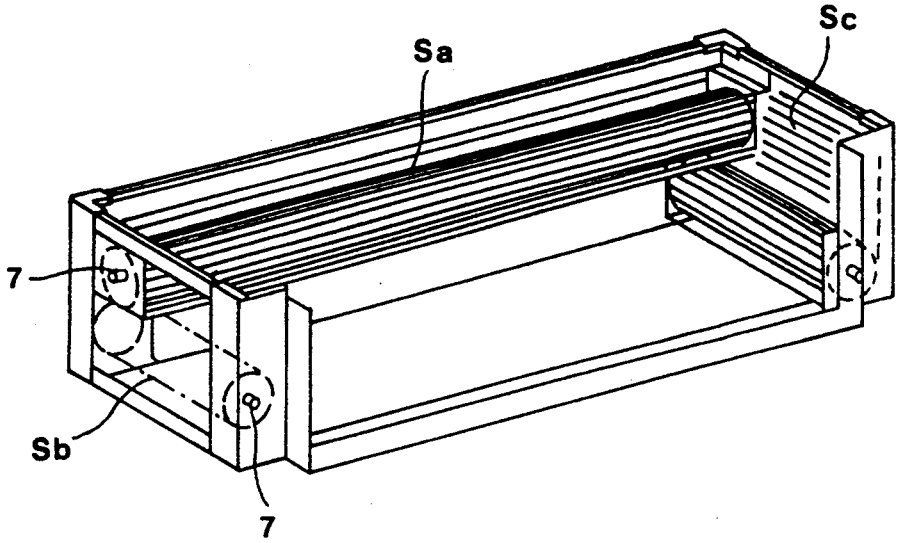
FIG. 4 is an inner perspective view of the lower containing space of the bay window.

The shutter assembly according to the present invention will be described in detail with reference to the attached drawings of a preferred embodiment of a three sided bay window with a front window A and two side windows B and C. In FIG. 1 through 5, reference numerals 1 indicate an opening in a building, numeral 2 indicates a bay window installed in the opening 1. Said bay window 2 is formed with three shutter frames 3 made of a front window A, two side windows B and C, a roof assembly 4 mounted on the shutter frames 3, in which assembly 4, a driving shaft 5 for operating a shutter curtain S consisting of a front and two side shutter curtains Sa, Sb and Sc is supported, and a lower containing space 6 under the window assembled integrally to be installed outside of the opening 1 as a completed product.

In the outer part of the lower space 6, a cylindrical winding shaft 7, consisting of separate shafts *7a*, *7b* and *7c*, for winding the shutter curtain S is supported in a position parallel to the windows. Inside of the shutter frame 3, window sash frames 8 are fixed.

The driving system for the shutter curtain S consists of hanging members 9, winding drums 10 fixed on both ends of the driving shaft 5 supported in the roof space 4 and a driving motor 11 connected to the driving shaft 5.

By connecting one end of the hanging member 9 to the winding drum 10 and the other end to each end of a leading member 51 of the shutter curtain S, and by driving the winding drum 10 in forward and reverse direction by the driving motor 11, the shutter curtain S runs along guide rails 13, 13 disposed vertically on jamb members 12, 12 as column members at each corner of the shutter frame 3 to close and open the window.

The curtain S is drawn out by the winding drum 10 from its wound state on the winding shaft 7 in the lower space 6 to extend upward to close the window and wound again around the winding shaft 7 to open the window.

In the present invention with a novel driving system of operation, taking into consideration the thickness of the winding shaft 7, the locations of guide rails 13 and the running path of the hanging member 9, the winding shafts 7 are disposed so as to cross and to have their ends one above the other at their ends.

Figure 5:
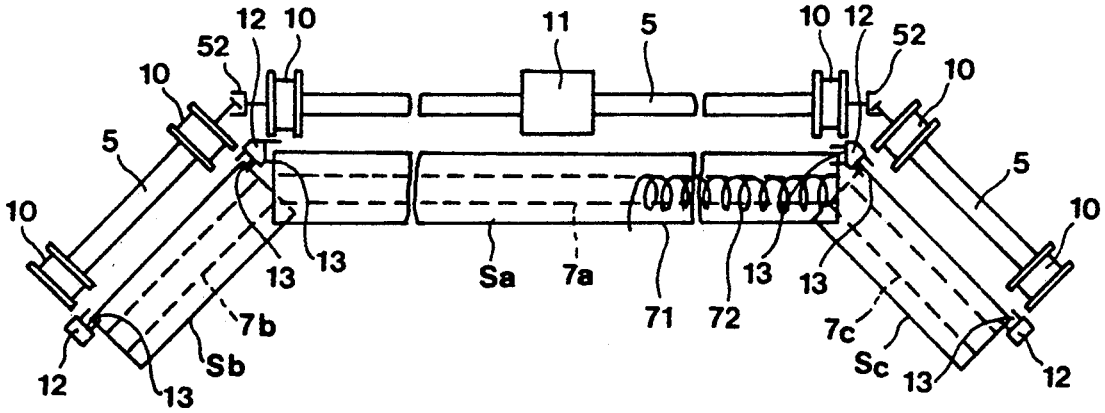
FIG. 5 is a plan view showing dispositions of the winding shafts relative to the driving shafts.
Figure 6:
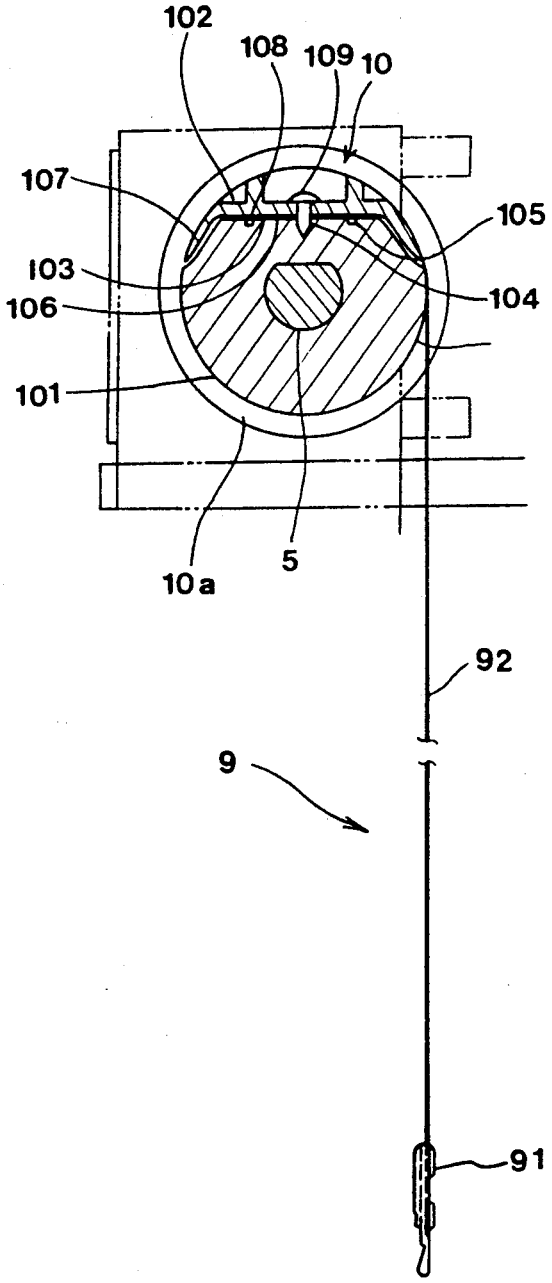
FIG. 6 through FIG. 10 illustrate hanging member and its connection to the winding drum.
Figure 7:
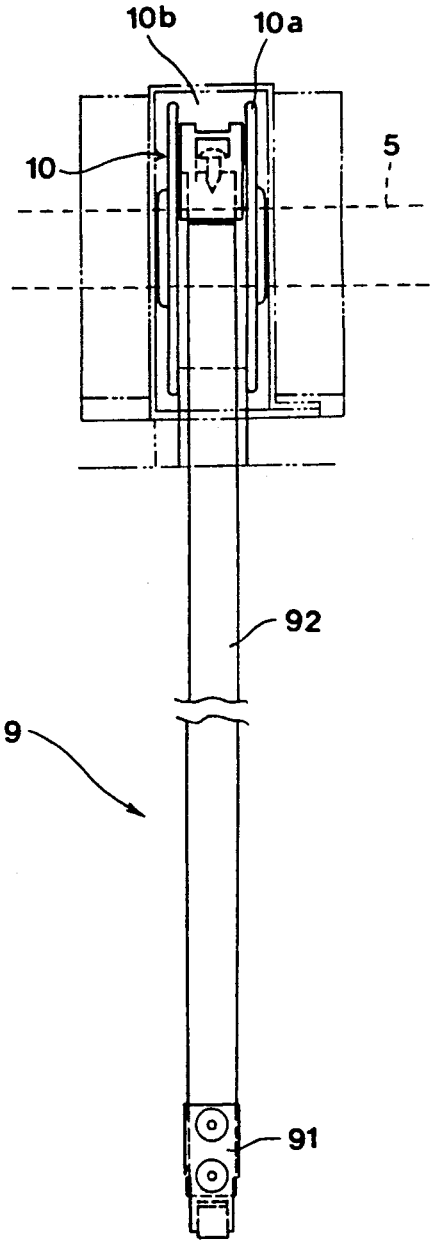
Figure 8:
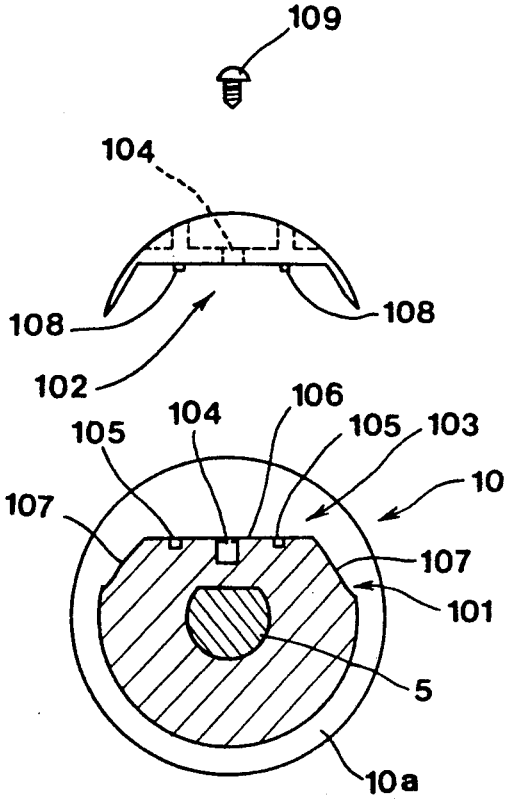
Figure 9:
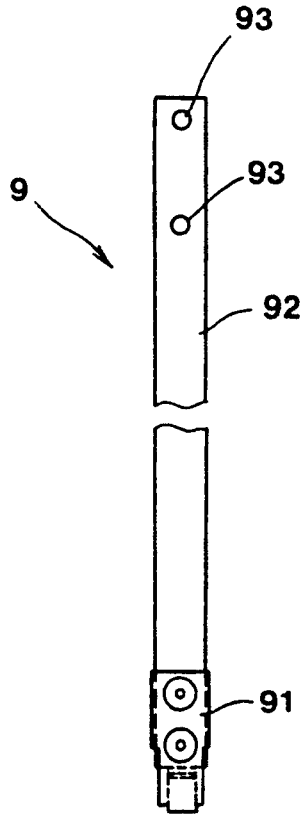

In the hollow winding shaft 7, as shown in FIG. 5 in part, between its drum 71, a biasing coil spring 72 is provided to store biasing force during ascending motion of the curtain S and to wind up the curtain during its descendance.

The driving shaft 5 is supported in the roof space 4 disposed parallel to and outside of the vertical plane above the winding shaft 7, and all parts of the driving shaft 5 are connected at the corner of the bay window with a set of universal joint or a set of bevel gear, not shown.

As for the hanging member applied in the present invention, a steel belt 9 of thin and strong nature is used for hanging the shutter curtain to be wound and unwound by the revolutions of winding drum 10 connected to the driving motor 11. Other materials such as synthetic resin tape or fabric belt of a conventional type can be used as an equivalent.

The steel belt 9, as shown FIGS. 6 through 10, is fixed on its lower end piece 91 which attaches to the ends of leading member 51 of the shutter curtain S, and on the other end 92 attaches with engaging holes 93 to the periphery of the winding drum 10. Here, the drum 10 is divided into 2 parts of a major main part 101 and a minor counter part 102 to hold the end 92 of the belt 9 in between.

The main part 101 forms a fixing part 103 for the belt 9 on its divided side provided with a flat part 106 with a screw hole 104 and receiving holes 105 and slanting parts 107 connecting to the ends of flat part 106. Meanwhile, the minor holding part 102 is formed to be fitted on the fixing part 103 and provided with a screw hole 104 and an engaging projection corresponding to the main part 101. Both parts 101 and 102 are connected with a screw 109 to fix the end 92 on hanging side of the belt 9. Accordingly, the belt 9 is fixed firmly along the fixing part 103 of the winding drum 10 by the holding part 102, and, by engagement of the projections 108 with the receiving holes 105 as well as the engaging holes 93 of the belt 9, no slippage nor loosening of the belt 9 occurs under the tension. The leading slope on the slanting part 107 in the direction of winding is natural and protects the belt 9 from sharp bending and damage. Moreover, the belt 9 is wound on the periphery of a groove **10*b* between flanges 10*a* of the winding drum 10 in layers, the diameter of the drum 10 can be small, reducing the space for its installing in the roof 4**.

In the second aspect of the present invention, as shown in FIGS. 10 through 15, the contacting of the bottom member of the shutter curtain with the floor surface to prevent possible gaps in an ordinary shutter is resolved by adopting a sealing device to the leading member 51 of the shutter curtain S to contact to the bottom surface of the roof assembly 4. The device 50 includes a set of sealing members disposed longitudinally along the opposite members to contact tightly to absorb a possible diagonal gap between them and also to prevent the noise of closing.

Figure 10:
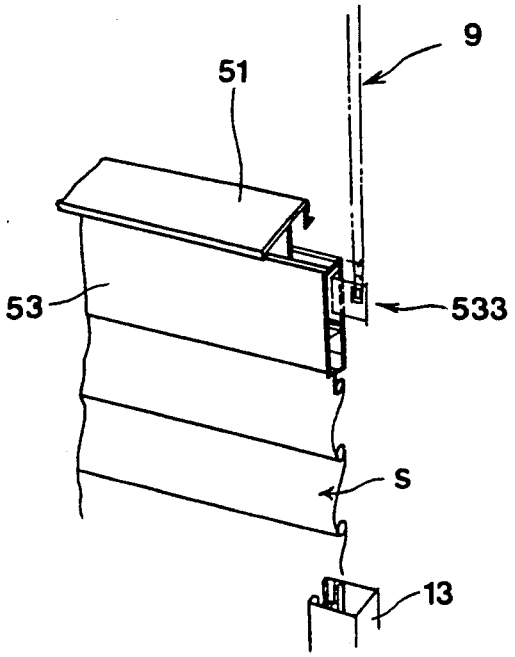
Figure 11:
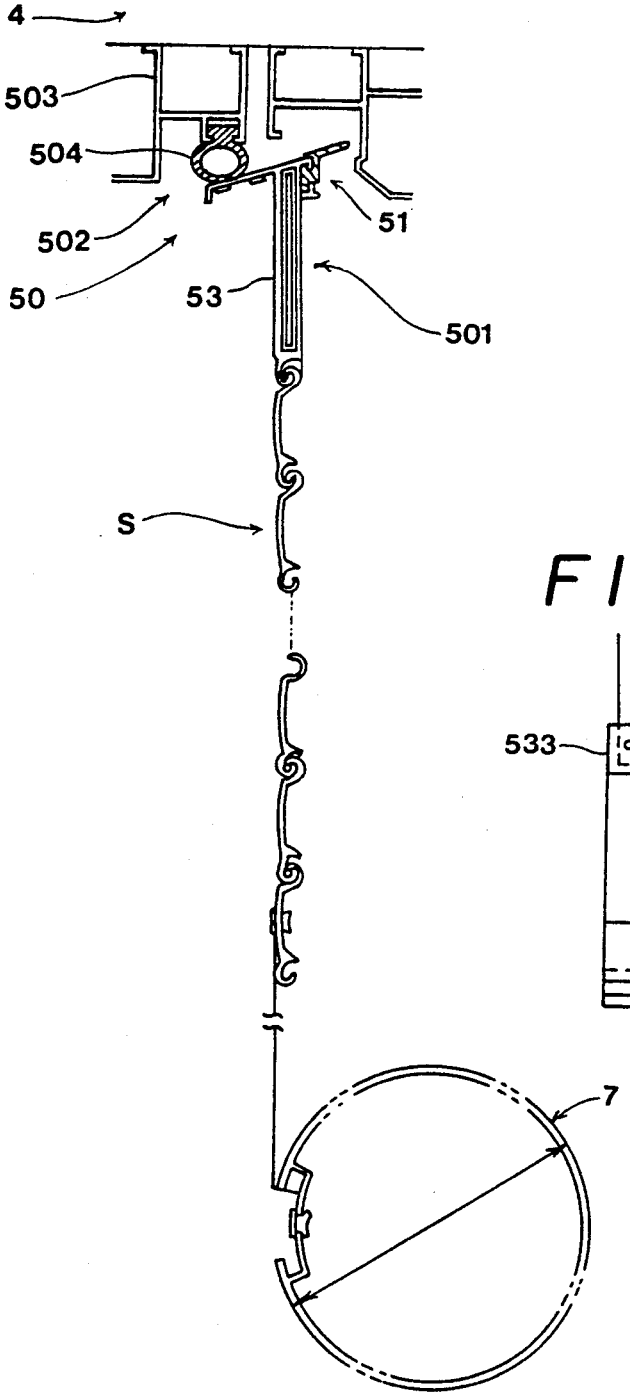
FIG. 11 through FIG. 16 illustrate a sealing device for the shutter curtain and the lower part of the roof.
Figure 12:
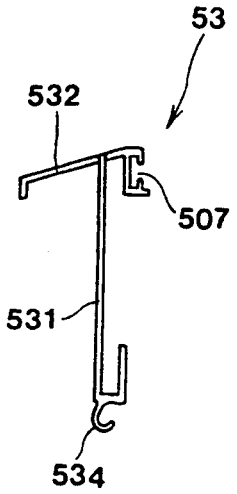
Figure 13:
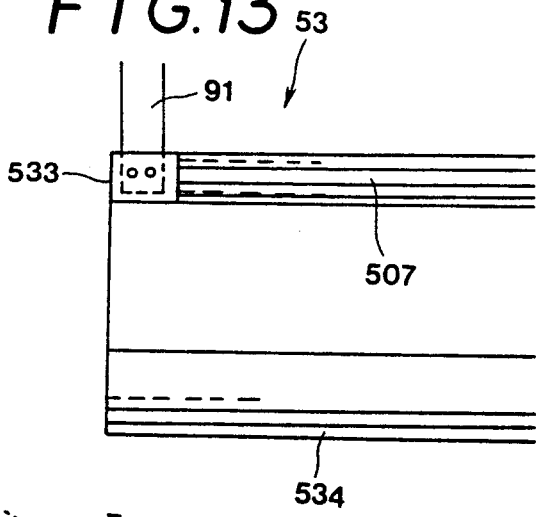

The sealing device consists of, as shown in FIGS. 10 and 11, a lower sealing member 501 including an upper end plate 53 disposed on the leading member 51 of the shutter curtain S and an upper sealing member 502 disposed on the bottom of the roof assembly 4 opposite above the lower sealing member 501. The upper end plate 53 corresponds to the above mentioned bottom member of the ordinary shutter and, as shown in FIGS. 12 and 13, is formed in a shape of T with its upright 531 and its arms 532 to contact with the upper sealing member 502 with a slanting frange to form an outward water flashing. Engaging part 533 for the lower end 91 of the belt 9 and 534 is an interlocking part of the shutter curtain S.

The upper sealing member 502 is formed by a cushion member 504 of a soft tube integral with its base portion fitted in a supporting member 503.

With the sealing device 50 described above, when the shutter curtain S is lifted up to close the window, if a diagonal gap remains under the roof part 4, the cushion member 504 of the upper sealing member 502 is pressed at the contacting portion by the lifting force of the curtain S to be deformed to prevent the forming of a gap.

Figure 14:
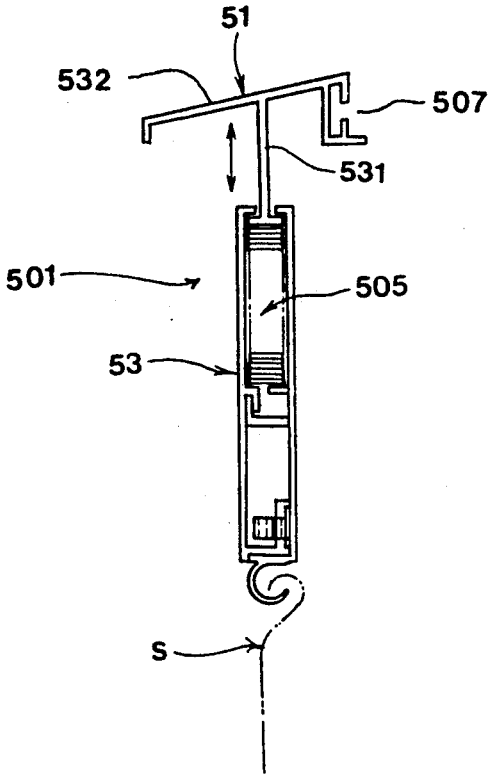

In the example shown in FIG. 14, the lower sealing member 501 is changed to be supported to have free vertical movement along the shutter curtain S to have a function of cushion. Here, by providing the upper plate 53 with a hollow upright 531 containing a spring 505 biased to raise the bottom of the upper plate 53, the scope of operation of the sealing device 50 is inceased to secure their action.

Figure 15:
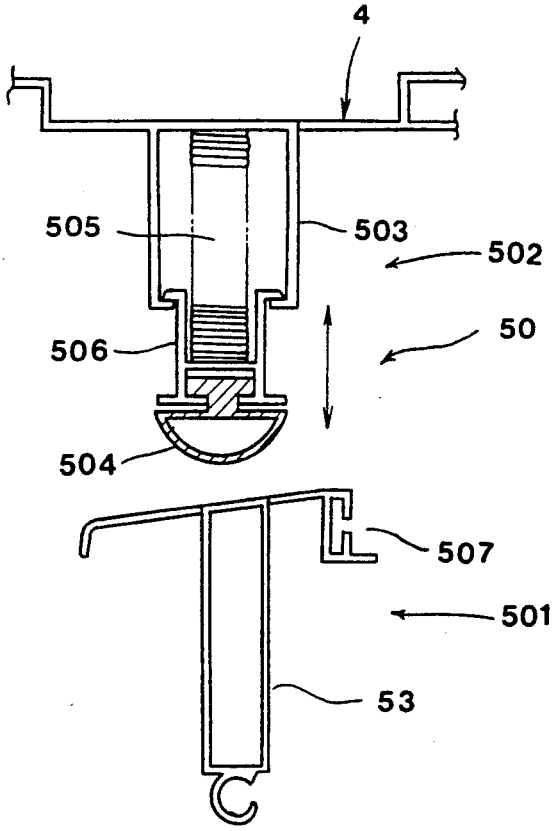

In another example shown in FIG. 15, the upper sealing member 502 is changed. In this embodiment, the function of the lower sealing member 501 described above is transferred to the upper sealing member 502 to absorb the gap on the roof side. The supporting member 503 is changed to have a function of cushion with an actuating member 506 and a biasing spring 505. The actuating member 506 is disposed between the supporting member 503 and the cushion member 504, and is capable of vertical movement to press the cushion member 504 downward. By this composition, the lower sealing member 501 is freed from the function of cushioning and the upper plate 53 can be fixed directly to the shutter curtain S.

Figure 16:
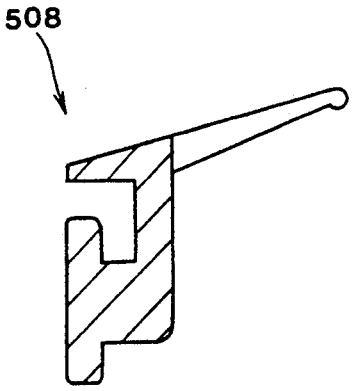
Figure 17:
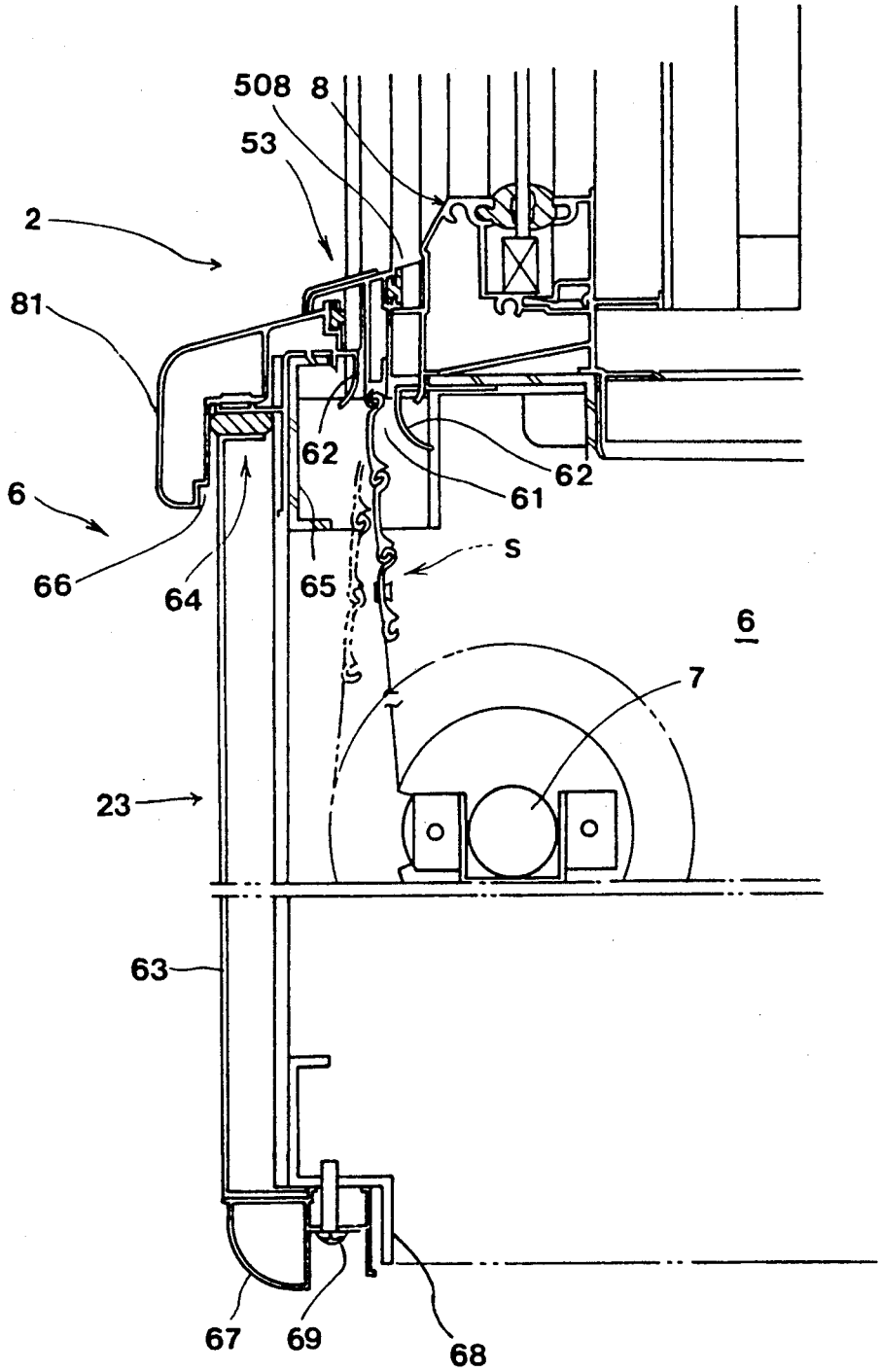
FIG. 17 is an enlarged detail of the lower part of the bay window.
Figure 18:
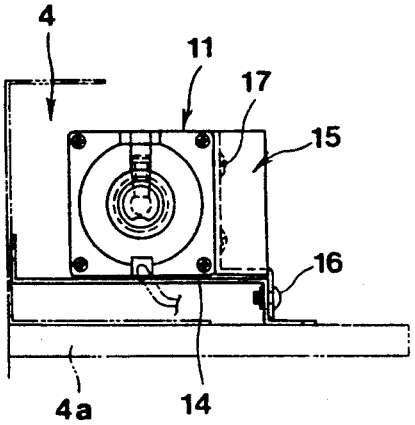
FIG. 18 through 22 illustrate fixing construction of the driving motor.

It is noted that when the shutter curtain S is open, corresponding to the fact that the bottom member of the ordinary shutter closes a passage slit for the shutter on the shutter case, as shown in FIG. 16 and 17, it is necessary to close more securely a passage slit 61 provided on the upper surface of the lower containg space 6. In the present invention, the top horizontal plate 532 itself of the upper plate 53 is formed to make a water flashing and is provided with a soft elastic tongue piece 508 in a side groove 507 to make a water tight contact with the window sash 8.

Further, to secure a smooth passing of the shutter curtain S through the passage slit 61, a pair of guide pieces 62 is provided along the slit 61 with their tips apart wider downward and the pieces 62 each acts as a guide for the curtain S, the outside one acting as a guide on ascension and the inner one acting as a guide on dissension. The same construction is applied for the bottom of the guide rails 13 in the present invention.

When the shutter curtain S is closed, however, the passage slit 61 remains open with the curtain S therethrough and the rain water flowing down along the outer surface cannot be stopped. Since the means of water tight sheathing over the slit 61 is difficult to perfect, the water is led into the space 6 to be drained from bottom thereof freely.

In the third aspect of the present invention, as shown in FIG. 18 through 22, the driving system contained in the roof space is improved. Firstly, a fixing construction of the driving motor 11 in the present invention is illustrated.

Figure 19:
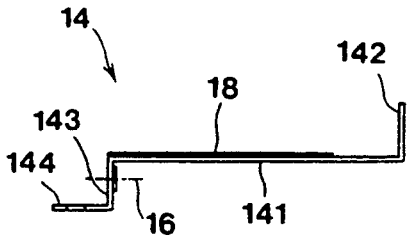
Figure 20:
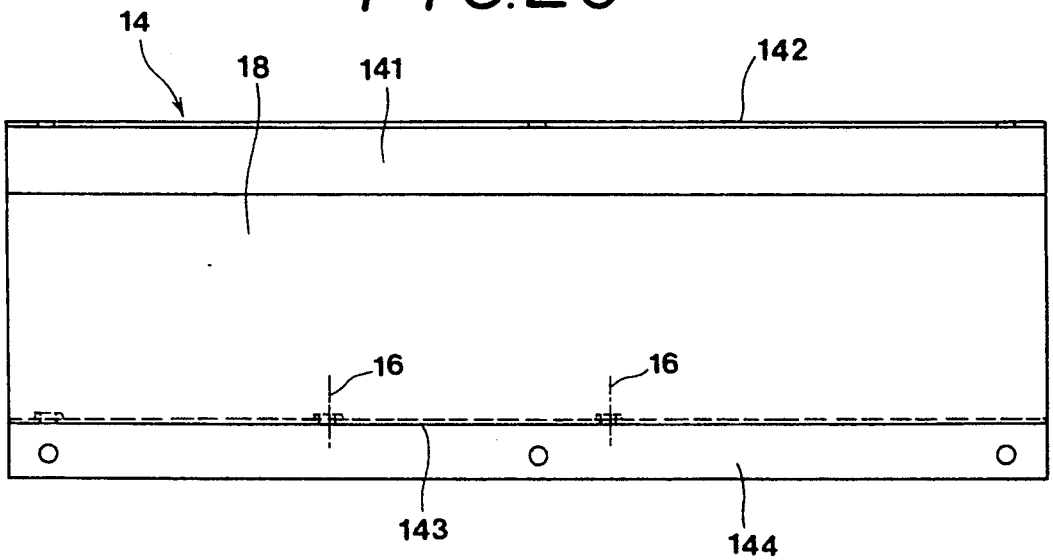

On the upper frame 4a located under the roof 4, a supporting seat 14 to support the motor 11 in coaxis with the winding drum 10 is provided. The seat 14 is, as shown in FIG. 19 and 20, made of a metal plate and is formed by bending with a central horizontal base 141, a bent up upper fixing flange 142, a bent down fixing wall 143 and a lower fixing flange 144.

Figure 21:
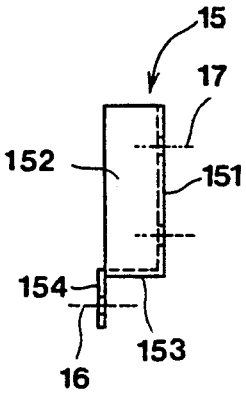
Figure 22:
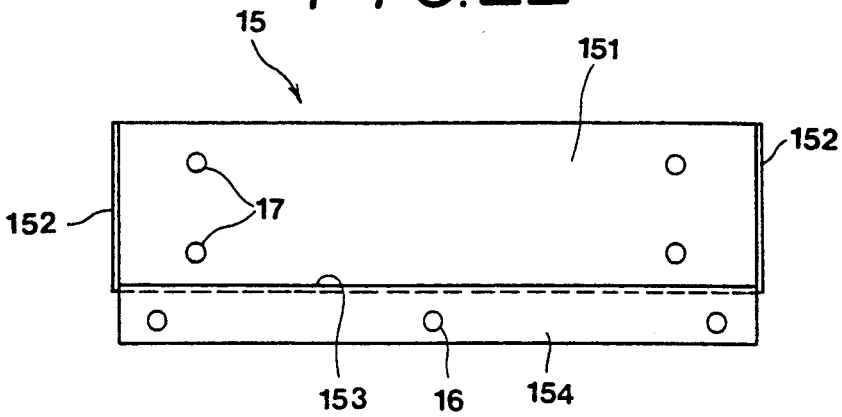

Meanwhile, on a inner side of the motor 11 a fixing plate 15 is fixed. The fixing plate 15, as shown in FIG. 21 and 22, is also made of folded metal plate with a main part 151, two flanges 152 at the ends of main part 151, lower flange 153 and a folded part 154 down from the lower flange 153. The folded part 154 of the fixing plate 15 is fixed detachably in front of the supporting seat 14 on the fixing wall 143 by screws 16 (including their holes), and the main part 151 thereof is fixed on the driving motor 11 by screws 17 (including their holes). Reference numeral 18 indicates a seat plate laid on the horizontal base 141 of the supporting seat 14 for the motor 11, which serves for the absorption of vibrations of the motor 11 without any fixing function.

Next, according to the upward lifting operation system of the present shutter, the second formation of the invention is illustrated.

Figure 23:
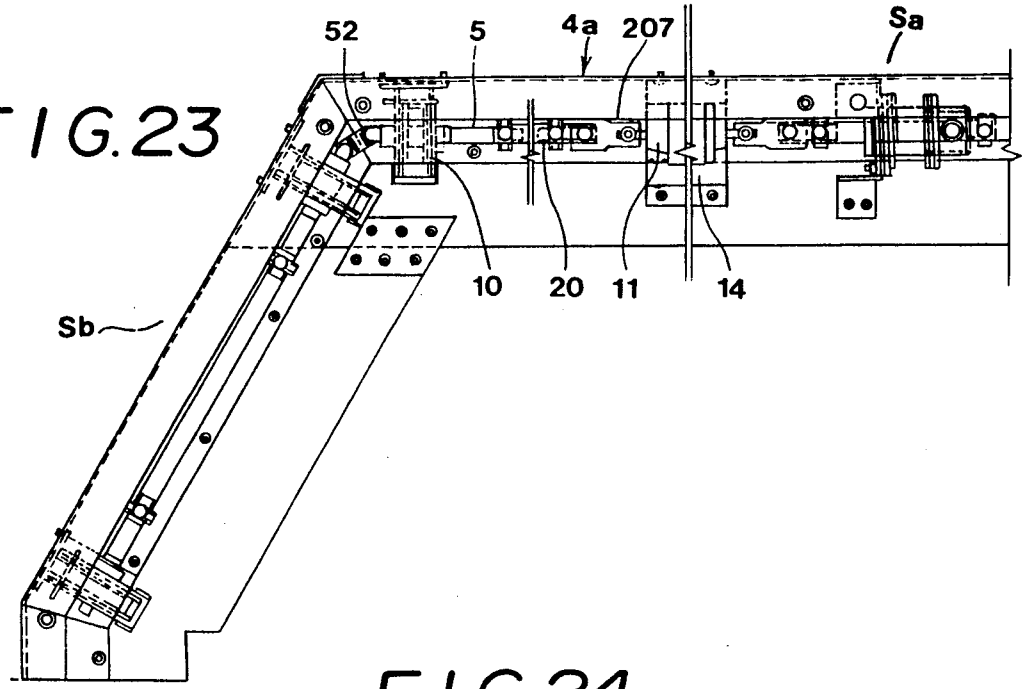
FIGS. 23 and 24 is a plan view and a side view illustrating connecting construction of the driving shaft to the driving motor.

In the shutter composed as described above, the motor shaft 111 of the motor 11 and the driving shaft 5 of the shutter curtain S are disposed as shown in the plan view of FIG. 5 and 23. In the present invention, the motor shaft 111 of the motor 11 disposed in the roof space 4 is connected to the driving shaft 5 for each of the sections of the curtain S by means of a connecting shaft 20 made separately from the both parts.

Figure 24:
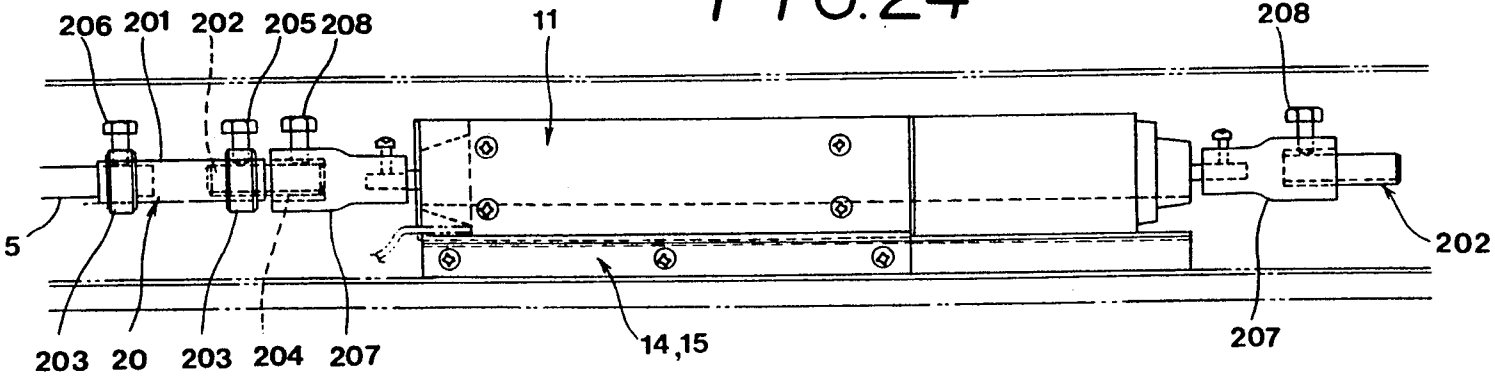

The connecting shaft 20 is, as shown in FIG. 24, a cylindrical hollow body made of metal and consists of a main body 201, a connecting rod 202 and collars 203 around both ends of the main body 201. The connecting rod 202 is half inserted in the main body 201 by a spline joint 204 formed one end next to the motor 11 of the main body 201, with its other end half projecting toward the motor shaft 111 of the motor 11, and is fixed by a screw 205 from outside of the collar 203. On the other end next to the driving shaft 5, the driving shaft 5 is inserted and is fixed in a same way as above by means of a collar 203 and a screw 206.

Meanwhile, on the outer end of the motor shaft 111, corresponding to the end of the main body 201, a socket 207 is fixed to receive the projecting half of the connecting rod 202 and to fix it by means of a spline joint 204 and a screw 208.

Accordingly, by inserting half of the connecting rod 202 in the socket 207 at the end of the motor shaft 111, and by inserting the rest of the rod 202 in the main body 201 of the connecting shaft 20, and with one end of the driving shaft 5 inserted in the other end of the connecting shaft 20 and by fixing each of the screws 208, 205 and 206, the driving output of the driving motor 11 is transmitted to the driving shaft 5 through the motor shaft 111.

When the disconnection of motor shaft 111 and the driving shaft 5 is required, by unscrewing the screw 206 for the driving shaft and the screw 208 for the motor shaft 111 for instance, the connecting shaft 20 can be moved toward the driving shaft 5 to release the projecting end of the connecting rod 202 fixed on the connecting shaft 20 can be drawn out of the socket 207 of the motor shaft 111.

Figure 25:
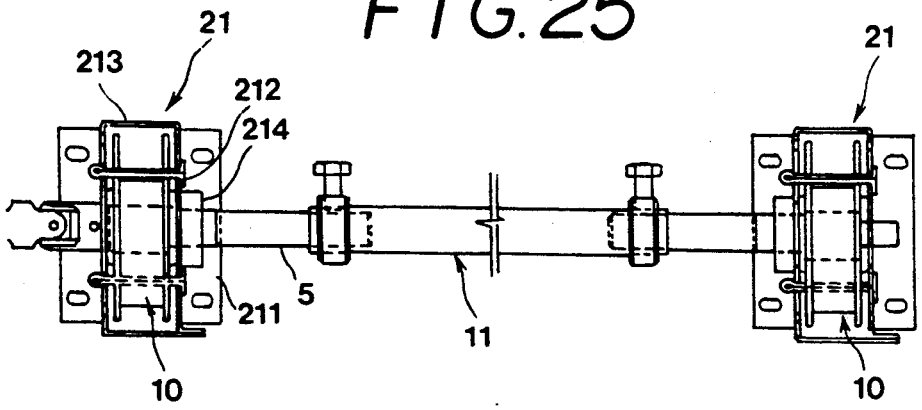
FIGS. 25 through 27 illustrate housing case of winding drum and each shows a front view, side view and a plan view.
Figure 27:
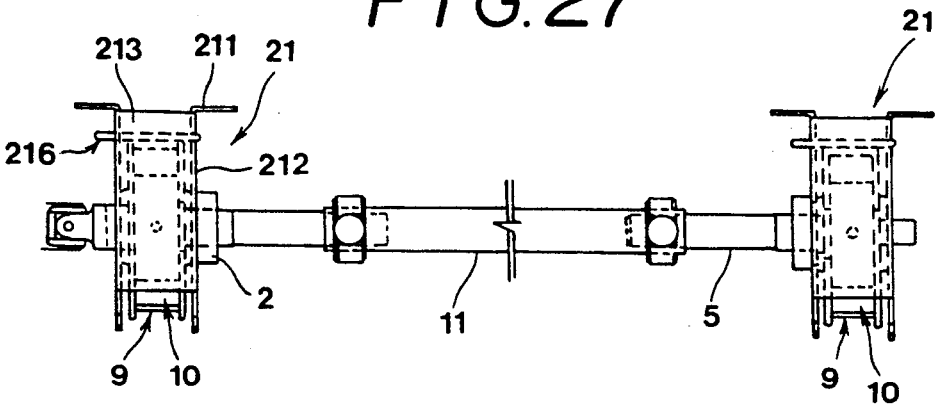
Figure 26:
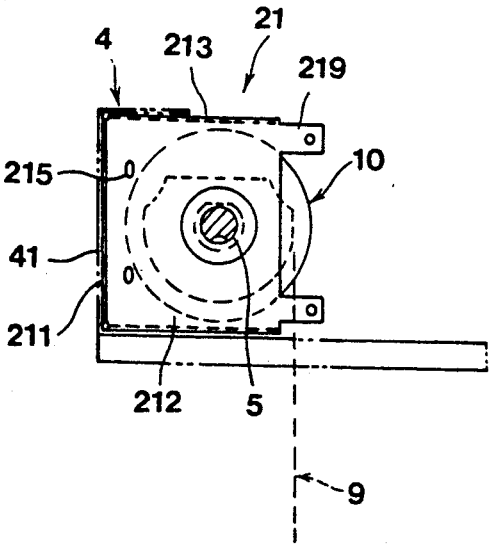

Covering over the winding drum 10, as shown in FIG. 25 through 27, supported on the roof assembly, a housing case 21 is provided. The case 21 is made in the shape of a box of a folded steel plate and serves as a supporting bracket for the driving shaft 5 and consists of a pair of flanges 211 to be fixed on the inside of a front plate 41 of the roof 4 and to support whole of the case, a pair of side plate 212 folded from the flanges 211 and a top plate 213 connecting the side plates 212. The drum case 21 supports the driving shaft 5 for the shutter curtain S penetrating the side plate 212 by a bearing 214 thereon. The driving shaft 5 revolves by the output of the driving motor 11 to wind and unwind the belt 9 on the winding drums 10 fixed on its ends. The drum case 21 covers the winding drum 10 without excess volume.

Figure 28:
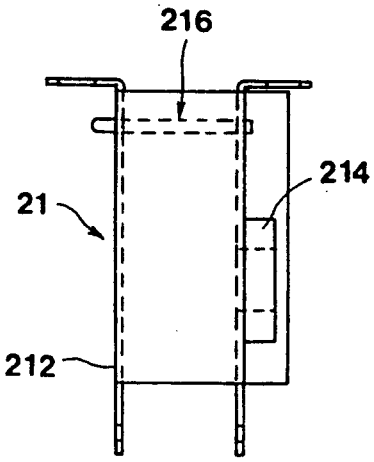
FIGS. 28 through 30 illustrate regulating member for the hanging member and each shows a plan view, front view and a side view.
Figure 29:
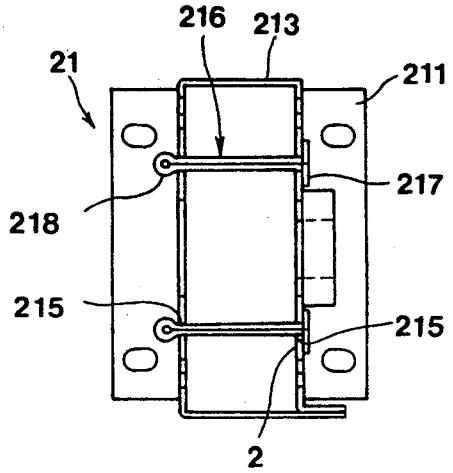
Figure 30:
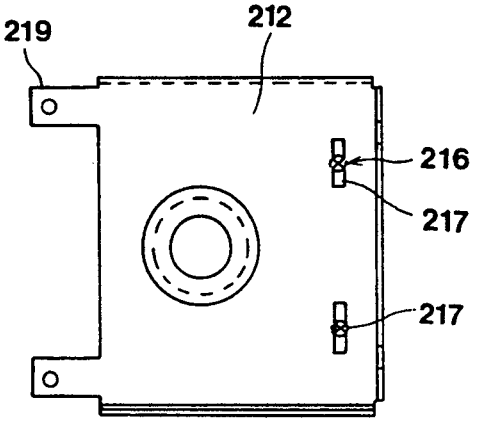

On the side plates 212 of the drum case 21, as shown in FIG. 28 though 30, near the periphery of the winding drum 10, upper and lower fixing holes 215 are provided. Between opposing holes 215, a split pin 216 for the belt 9 is supported. The pin 216 is of an ordinary type and its legs 217 are inserted from a hole 215 to pass through an opposite hole 215 and then with its head 218 contacted on the outside of the side plate 212, the legs 217 are opened and folded to be fixed. Accordingly, the belt 9 wound around the drum 10 in layers in a large diameter at the end of winding operation can be regulated and prevented from the running off the groove **10*b* of the drum 10**.

Reference numeral 219 indicates a fixing part for a front cover of the case.

Figure 31:
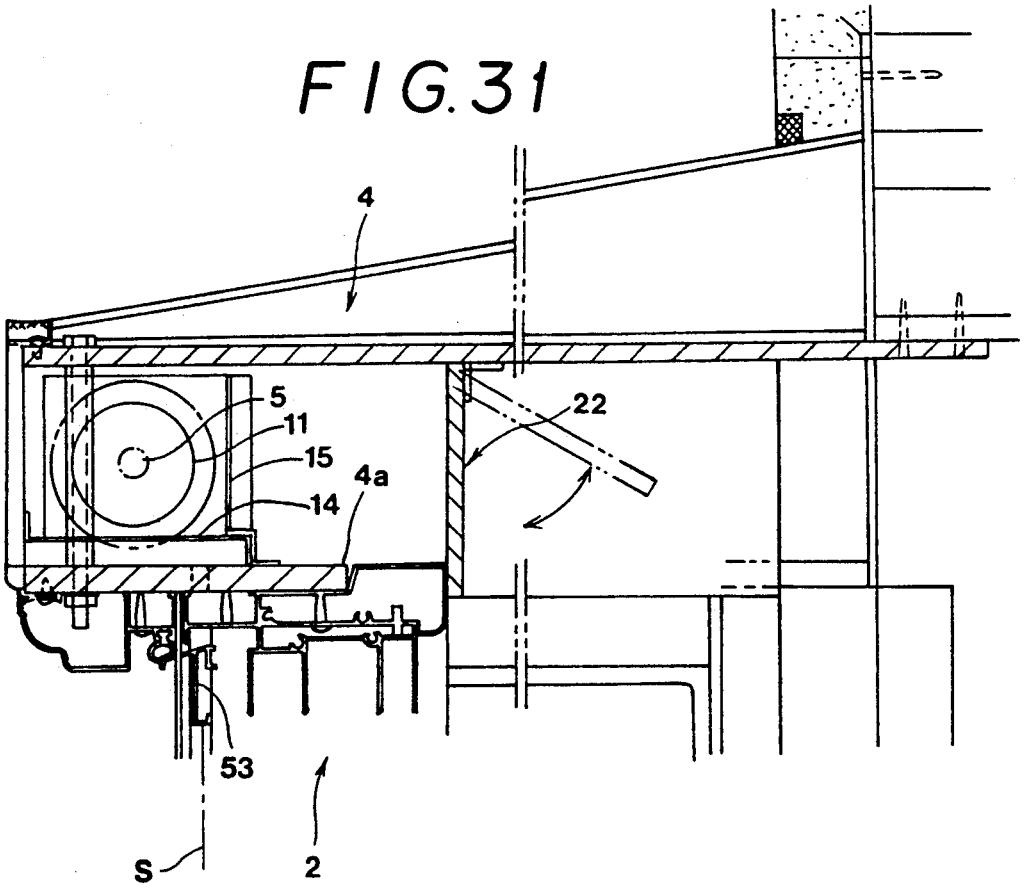
FIG. 31 shows a detailed cross section of the access aperture.
Figure 32:
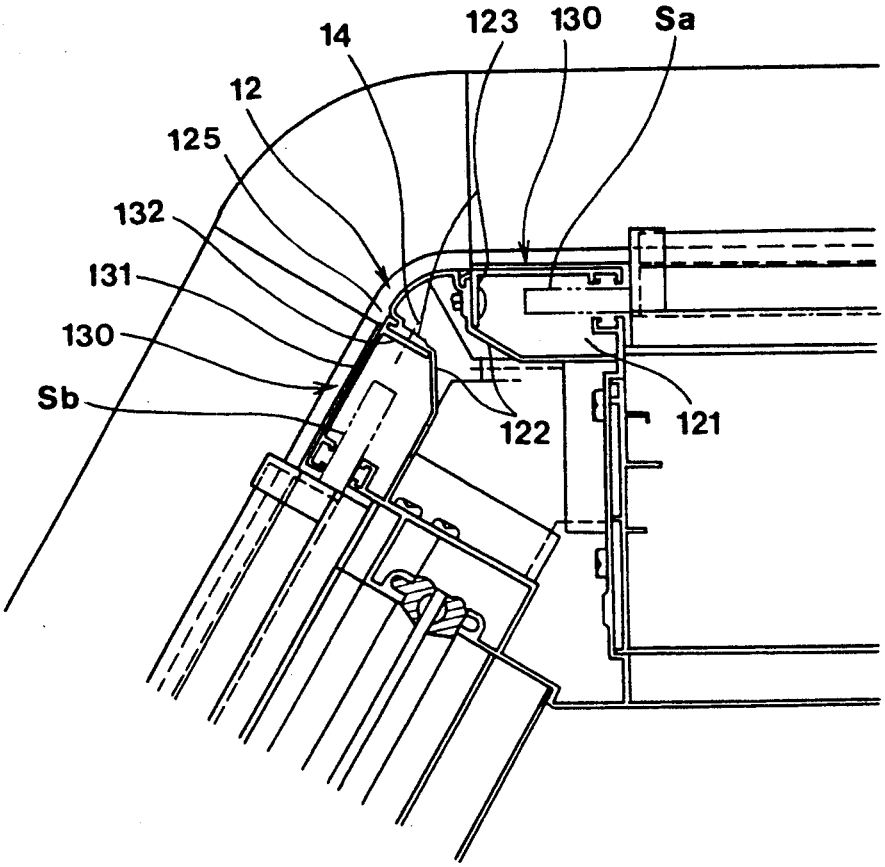
FIGS. 32 through 35 illustrate construction of a guide rail.
Figure 33:
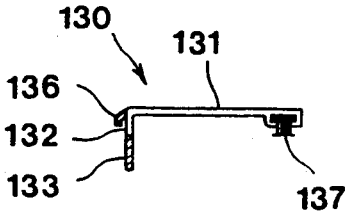
Figure 34:
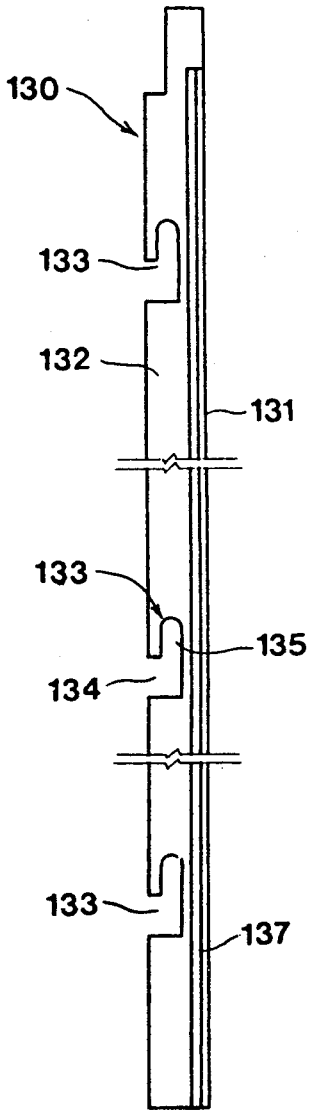
Figure 35:
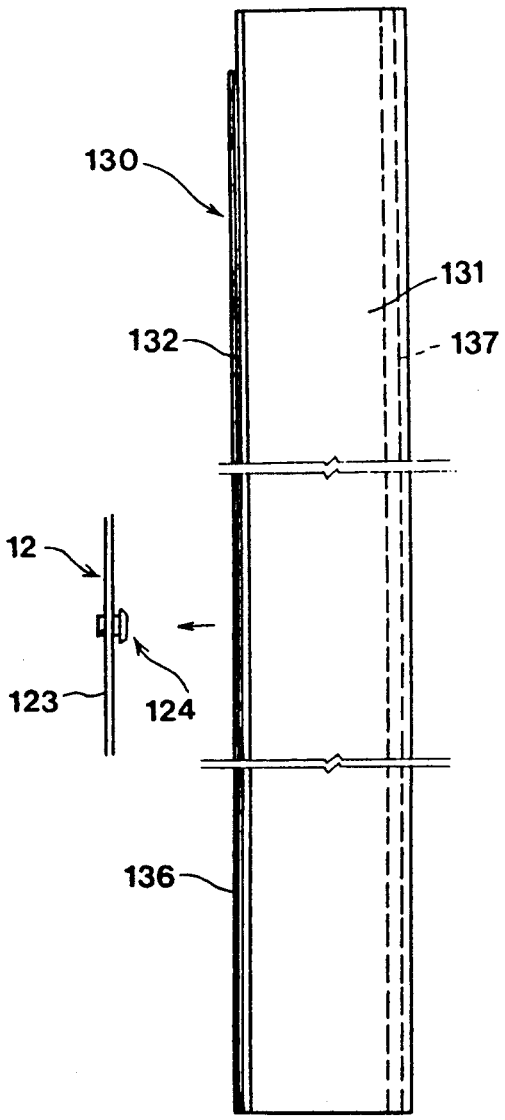

As a result of the construction, the driving motor 11, driving shaft 5 or other composing members of the driving system, as shown in FIG. 31, are all accessible from an access hole 22 provided on indoor side of the bay window 2 easily, and can be dismantled by unscrewing some of the screws and by shifting, and the process of maintenance for a long member such as the driving shaft 5 is executed with ease, and the driving motor 11 can be taken out of the position of supporting plate 14 together with the fixing plate 15.

Meanwhile, because the lower containing space 6 is used as an ordinary closet or used as a built-in sofa (indicated as D in FIG. 2) from inside of the room, for the maintenance of the winding shaft 7, as shown in FIG. 17, an access hole 23 is formed on outside of the lower space 6 with a panel 63. The upper edge 64 of the panel 63 is held inserted in a groove 66 formed between the flashing edge 81 of the window sash 8 and an upper frame member 65 of the space 6 with interposing sealing member, while the lower edge 67 of the panel 63 is fixed on a lower frame member 68 of the space 6 by means of screws 69 to be engaged detachably with the containing space 6.

Guide rails 13 adopted as the fourth aspect of the present invention are installed on the jambs 12 detachably. The guide rail 13 is, as shown in FIG. 32 through 35, formed by a part of the jamb 12 and a rail member 130 into a usual groove shape.

The jamb 12 forms a half side of the guide rail 13 at a square cutout 121 formed on its outside corner with a side wall 122 and an end wall 123 in a shape of an L and the rail member 130 is made as a long unit member in an L shape corresponding to said cutout 121 and consists of a longer front side wall 131 and a shorter end wall 132. On the end wall 132 of the rail member 130, a plurality of receiving parts 133 in a row are formed, and on the opposite part of the end wall 123 of the jamb 12, a series of engaging members 124 are provided to engage with the receiving parts 133 to form the guide rail 13. Here, each receiving part 133 consists of a horizontal groove 134 with its mouth open to the edge of the end wall 132 and a vertical groove 135 connecting to the inner end of the groove 134 and bent upward, while the engaging member 124 is formed like an ordinary bolt with a head and a shaft.

By positioning the rail member 130 in front of the cutout part 121 of the jamb 12 and engaging the horizontal groove 134 with the shaft of the engaging member 124, and then sliding the rail member 130 and lowering it, both of the end walls 123 and 132 are combined by the head of the engaging bolt 124. A joiner 136 provided at an outer corner of the rail member 130 engages with a vertical groove 125 provided at an outer corner of the jamb 12 to align the jamb 12 and the rail member 130. Numeral 137 indicates a mohair strip and its holder for smooth sliding and air-tightness between the rail member 130 and the shutter S.

Figure 36:
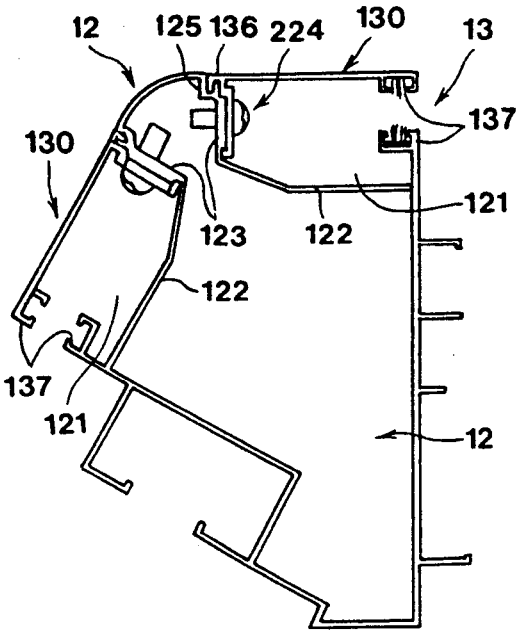
FIGS. 36 through 38 illustrate other embodiment of the guide rail member.
Figure 37:
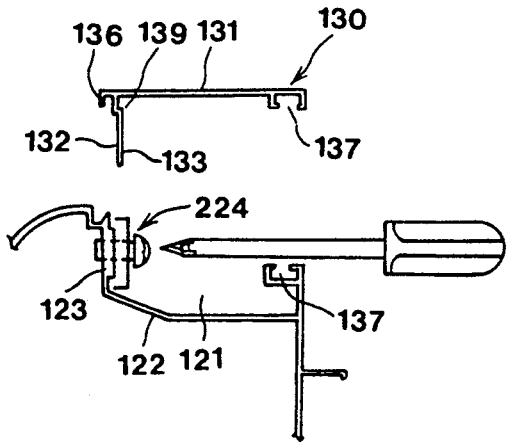
Figure 38:
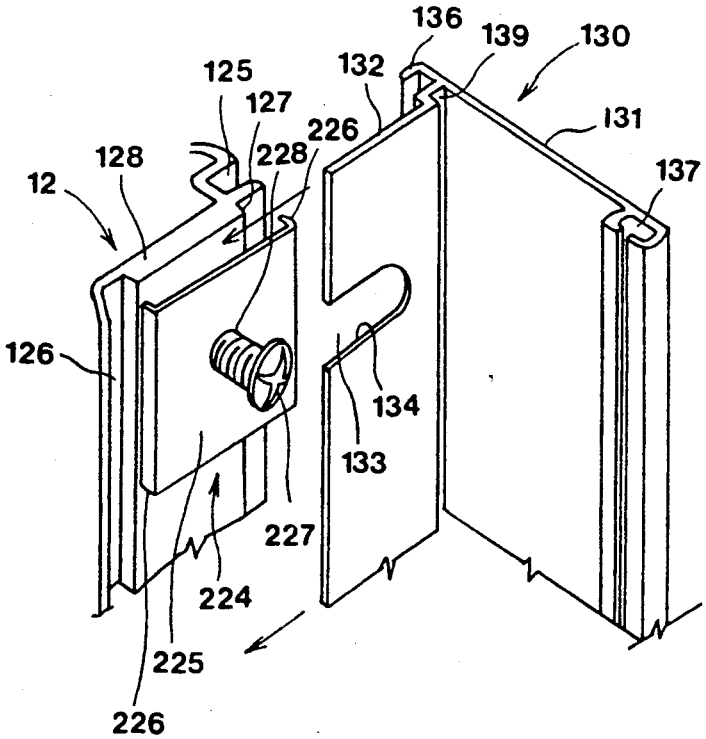

FIGS. 36 through 38 show another embodiment of the invention. The main differences from the aforesaid example lie in that the receiving part 133 lacks the vertical groove 135 and in that the engaging member 124 is changed to a coupling device 224 to engage with both the jamb 12 and the rail member 130 detachably.

To further describe the example, in the receiving parts 133, simple horizontal grooves 134 are formed with their openings on the edge of the end wall 132, and at the inner corner of the rail member 130, the end wall 132 is folded in a step to form a vertical groove 139.

On the other end wall 123 of the jamb 12, a zone with a thicker part 128 is formed to produce a vertical groove 126 and a step 127 each at the inner corner and on the edge thereof, and the step 127 contacts with the outside step of the vertical groove 139 of the rail member 130.

Next, in the invention, relating to the lapping engagement of the end wall 123 of the jamb 12 and the end wall 132 of the rail member 130, a coupling device 224 is adopted. The device 224 is prepared in the same number as the receiving part 133 and consists of a main body 225, vertical flanges 226 formed at both edges of the main body 225 and a engaging screw 227. The main body 225 has a width spanning from the vertical groove 126 provided on the end wall 123 of the jamb 12 and the vertical groove 139 provided on the rail member 130 to engage with these grooves by the flanges 226, and the screw 227 is inserted into a hole 228 provided in the center of the main body 225 and, passes through the horizontal groove 134, then reaches to be screwed to the thicker part 128. The screw 227 must have a thickness of its shaft capable of sliding along the groove 134 and the head must be larger than the hole 228.

Accordingly, as shown in FIGS. 37 and 38, with the screw 227 through the main body 225 of the device 224 loosely screwed on the end wall 123 of the jamb 12, then, by inserting the end wall 132 of the rail member 130 between the end wall 123 and the main body 225 from outside, with the horizontal groove 134 of the receiving part 133 sliding along the screw shaft, both of the end wall 123 and 132 can be overlapped to form the entire guide rail 13. Then, from the mouth of the guide rail 13, the engaging screw 227 is tightened, and the flanges 226 of the main body 225 engage with the vertical groove 126 and 139 each of the jamb 12 and the rail member 130, while the main body 225 functions as a washer for the screw 227 to fix the rail member on the jamb firmly to complete the whole of the guide rail 13.

In the guide rail member 130 of the invention, with the horizontal groove 134 of the receiving part 133 formed on the end wall 132, the direction of installing the member is always from outside of the jamb 12 and by tightening the screw 227, whereby the rail member 130 is combined to the jamb 12 integrally.

In the guide rail 13 constructed as above, as shown in FIG. 10, the side end of the shutter curtain S as well as the hanging belt 9 operate the curtain S run side by side.

In adopting the shutter for a bay window of the present invention, as the second embodiment according to the second invention, the driving system of the shutter can be modified to have another formation.

Figure 39:
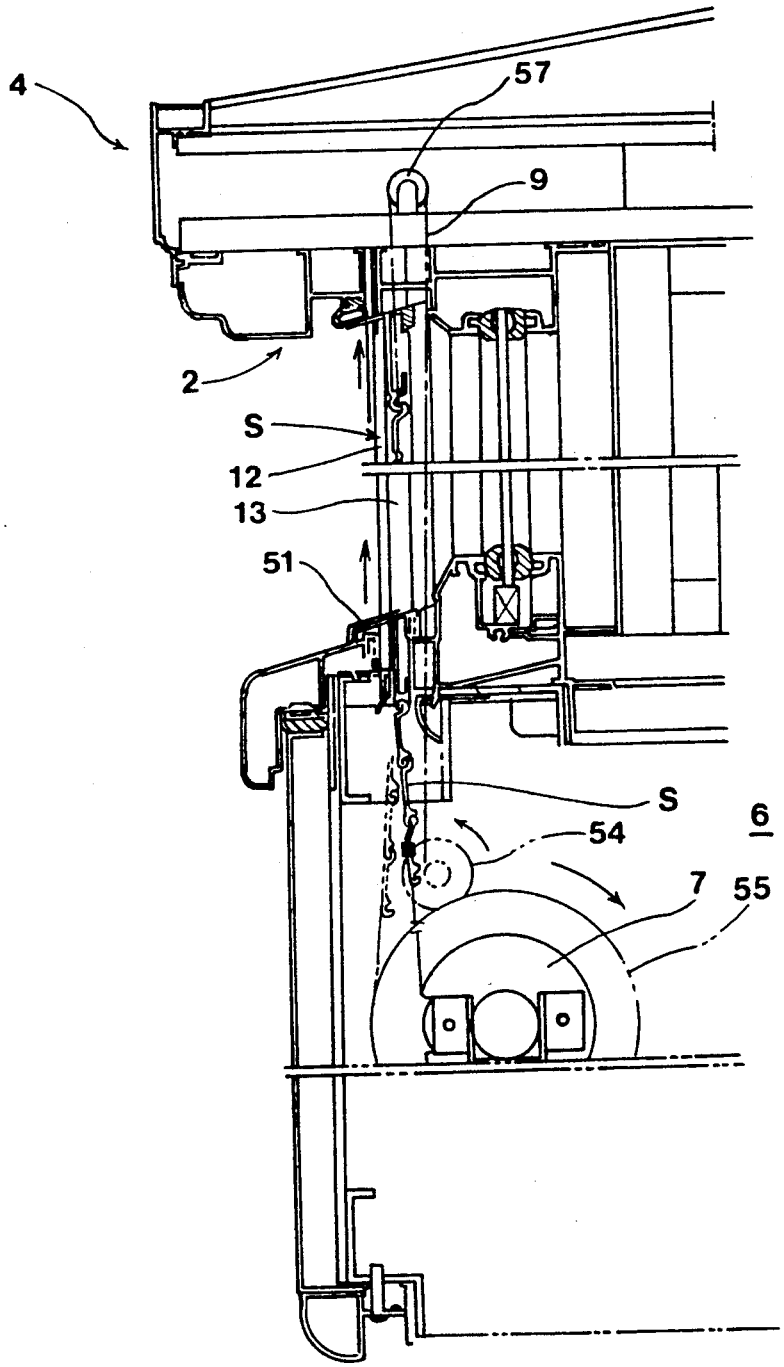
FIGS. 39 through 41 illustrate the driving system according to the second invention.
Figure 40:
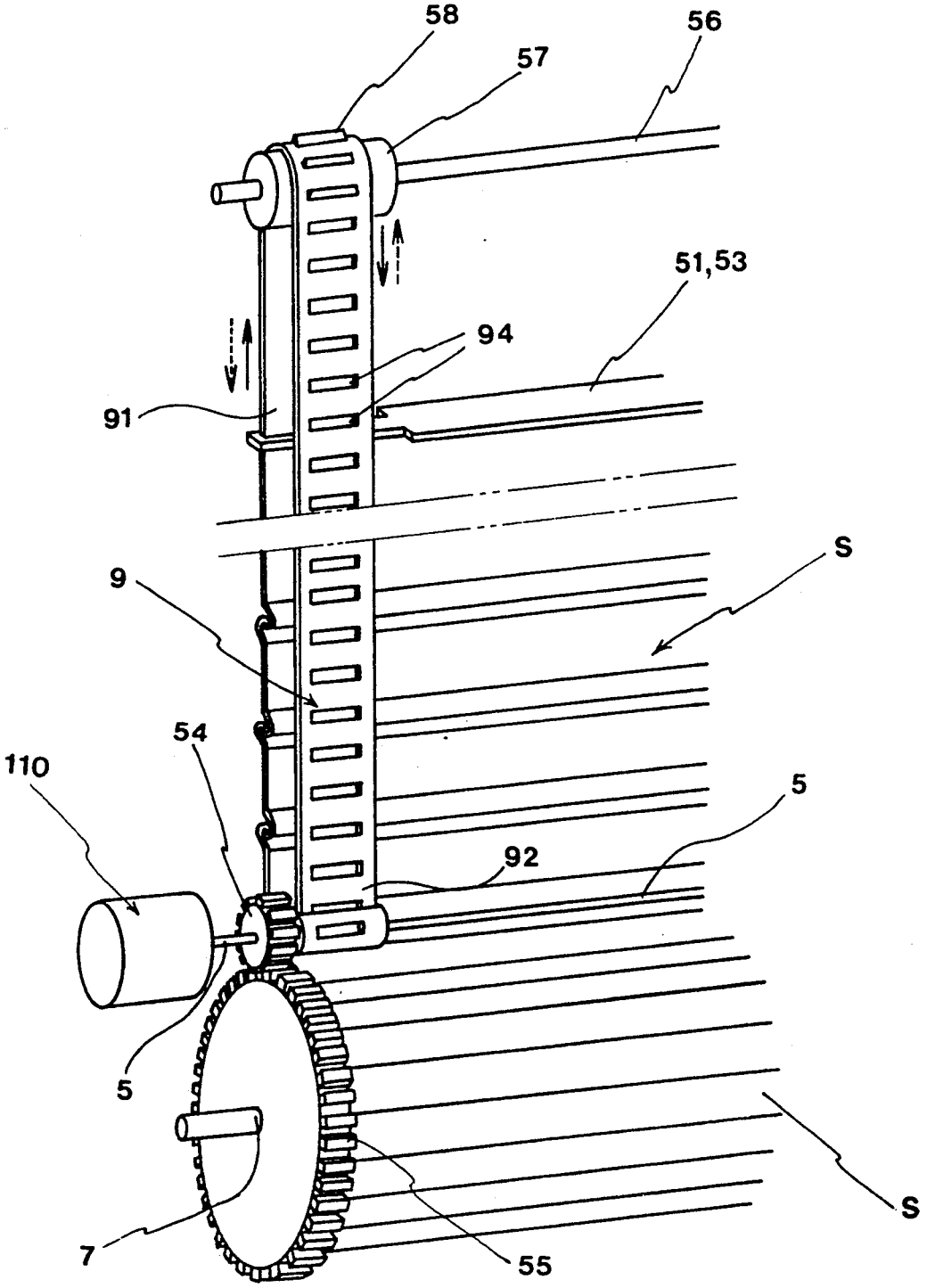
Figure 41:
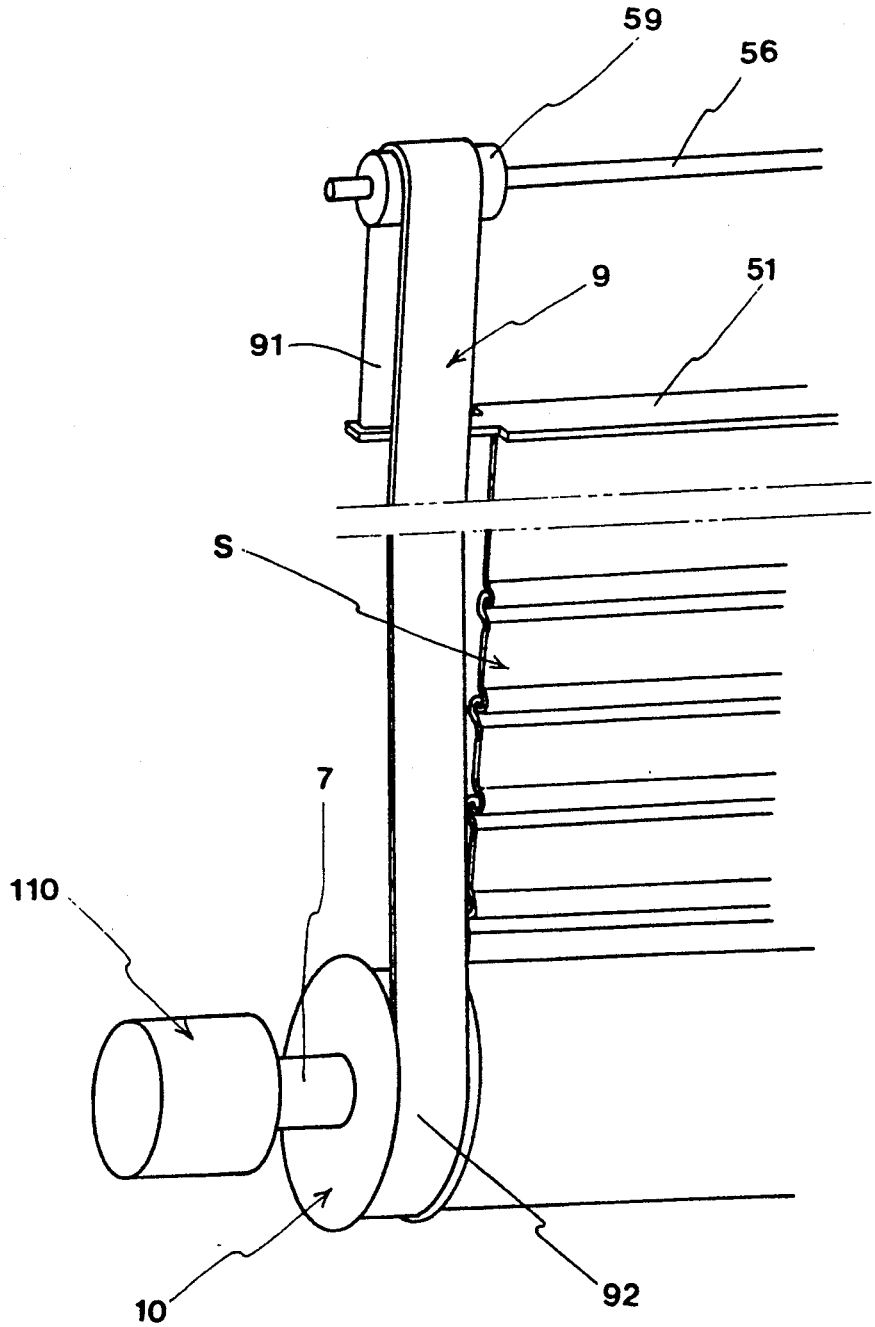

The second system is mainly directed to have both of ascending and descending operation of the shutter curtain S driven positively by driving force of the driving motor as well as to have the driving system disposed in the lower containing space 6 removed from inside of the roof space 4 to lighten the construction of the roof assembly. In FIGS. 39 and 40, the bay window 2 is shown in a vertical sectional view and the reference numerals for corresponding parts to the previous embodiment are indicated in common.

In the present embodiment, beside the winding shaft 7 of the shutter curtain S supported in the lower space 6, above it and parallel to it, a driving shaft 5 and also a operation driving motor 110 connected to the shaft 5 are disposed therein. At both ends of the driving shaft 5, a pair of driving gears 54 are fixed, each engaging with a dependent gear 55 fixed on the end of the winding shaft 7, and these gears revolve in counter directions by the driving of the single motor 110.

On the winding shaft 7, the lower end of the shutter curtain S is fixed and on the end of a upper plate 53 at the leading end thereof, fixed there as a hanging end, one end 91 of a hanging member 9 is fixed.

The hanging member 9, after being wound around an intermediate sprocket 57 provided rotatably on the hanging shaft 56, has its other end 92 fixed on the driving shaft 5. Here, the intermediate sprocket 57 has many teeth 58 on its periphery, while the belt 9 as the hanging member has a series of holes 94 at intervals to engage with the teeth 58 in a form of a driving chain to transmit the output of the motor 110 to the shutter curtain S. Then, the winding shaft 7 is driven by the driving motor 110 and the operation of the shutter curtain S drawn out of the state wound on the winding shaft 7 to close the opening 2 and returned to the state wound on the winding shaft 7 to open the opening 2 are carried out precisely and smoothly. Therefore, not only the necessity of a biasing coil spring 71 in the winding shaft 7 is eliminated but, the members disposed in the upper part being the sprockets 57 and their supporting shaft 56 only, the roof assembly 4 can be made small and the weight thereof can be much reduced.

Next, in an embodiment shown in drawing 41, the construction described above is further improved.

The driving motor 110 is connected directly to the winding shaft 7, and one end 92 of the belt 9 is fixed directly on the winding drum 10 at the end of the shaft 7 and the other end 91 is wound around an intermediate sheave 59, provided on the supporting shaft 56 in place of the intermediate sprocket 57, to be fixed to the leading member 51 on the other side of the shaft 56 to hang the shutter curtain S.

Accordingly, in this driving system, the winding direction of the driving motor 110 for the belt 9 corresponds to the releasing direction of the shutter curtain S to close the opening 1 and to open the opening 1 the reverse operation of the motor 110 is enough. With this system, the belt 9 is not engaged with the intermediate sheave 59 to absorb the difference of the diameter due to thickness between the winding drum 10 and the winding shaft 7.

In the shutter of the two embodiments according to the invention described above, the fundamental driving system is entirely new by having both the opening and closing operate by positive driving. Thus the system can be utilized not only for the limited examples of shutters described for a bay window, but it is easily understood that the system is available to the conventional shutter such as ones for ordinary entrance or flat window with the driving motor 10, the driving shaft 5 and the winding shaft 7 all contained in a shutter case fixed on the upper structure.

INDUSTRIAL APPLICABILITY

The present invention presents a novel shutter assembly for a bay window comprising a shutter curtain to be wound around a winding shaft contained in a lower containing space formed in a bay window, a driving system contained in a roof space, said system being consisted of a pair of winding drums supported on each end of a driving shaft supported in the roof space and connected to a driving motor operable in winding and unwinding direction and a pair of hanging members each connected on its one end to said winding drum and on its other end to an end of leading member of the shutter curtain, and a pair of guide rails provided on jambs deviding surfaces of the bay window at its corner to guide the ends of shutter curtain, in order to close the shutter curtain by upward operation of the driving motor and to open it by reverse operation of the motor with downward winding of winding shaft biased by the coil spring therein.

In the shutter assembly according to the invention, the basic idea being quite novel, various components of a special type are adopted to accomplish a shutter assembly of a lifting-type. In the embodiments of the invention, there is provided a sealing device for the upper end of the shutter curtain to the lintel member of the opening, installing means for the driving motor, connecting means for the driving shaft, and relations between the winding drum on the driving shaft and hanging member for operation of the curtain as well and their construction is given. Therefore, detailed explanations for the new composition and their means of maintenance are disclosed.

By showing further embodiments of the second invention, another developed type of a shutter assembly for a bay window with a shutter curtain driven by a driving motor to open and close any opening positively is disclosed. That not only provides a more simple driving shaft and a winding shaft without a biasing coil spring installed therein, but all the weight of the driving system is concentrated in the lower part of the window to enable the construction of the roof assembly to be of lighter weight and of smaller construction.

Further, the invention provides applicability, not limited for a bay window, but for various types of coventional shutters.

We claim:

1. A shutter assembly in combination with a bay window, said bay window having multiple protruding sides divided by corner jambs and including a roof having a roof space, a window portion, and a lower container space formed in said bay window below said window portion, said shutter assembly comprising:

a shutter curtain on at least two sides of the bay window for selectively closing off the window on the respective sides, each said shutter curtain having a top leading member, a bottom edge, and two side edges;

an elongate winding shaft for each shutter curtain, each shaft having a longitudinal axis and positioned in said lower container space with each said longitudinal axis parallel to the plane of the associated bay window side, each said winding shaft containing a coil spring and being biased by said coil spring in a first direction to wind said shutter curtain on said winding shaft, said bottom edge of each shutter curtain being fixed to its respective winding shaft;

a driving system, located in said roof space, comprising, for each shutter curtain, a driving shaft having a longitudinal axis, and pair of winding drums, one supported on each end of said driving shaft, said driving system further comprising at least one driving motor connected to at least one of said driving shafts;

a pair of elongate hanging members associated with each said driving shaft, each hanging member having two ends, a first end being connected to its respective winding drum and a second end connected to the top leading member of a respective one of said shutter curtains; and a pair of guide rails corresponding in number to the number of shutter curtains, one each of said pairs of said guide rails being fixed to the corner jambs of the bay window, said side edges of the respective shutter curtain being slidably received in said guide rails, said hanging members of each pair being guided in said guide rails; whereby said shutter curtains are moved from an open to a closed position by activating said driving system to rotate said winding drums on said driving shafts in a direction opposite said first direction, causing said hanging members to pull up on said top leading members, and in turn causing said curtains to be raised in said guide rails, and said curtains are moved from a closed to an open position by reversing the direction of rotation of said drive shaft, thereby causing said hanger members to move down and allow said top leading members, and said curtains to be lowered in said guide rails and be wound on said winding shafts under the influence of said coil springs; and wherein the longitudinal axes of adjacent ones of said winding shafts are situated in separate, vertically spaced, horizontal reference planes, and the longitudinal axes of adjacent ones of said driving shafts are located in a common horizontal reference plane, such that the ends of adjacent winding shafts cross in the region of the corner jambs, and said winding shafts are positioned with their longitudinal axes further inward of the sides of the bay window than the longitudinal axes of the driving shafts.

2. The shutter assembly for of claim 1, wherein adjacent driving shafts are connected together by at least one universal joint, said universal joint being located in the vicinity of the corner jamb of the bay window.

3. The shutter assembly of claim 1, wherein each said hanging member is a flat steel belt.

4. The shutter assembly according to claim 3, wherein each said winding drum comprises a major part and a mating minor part, said first end of the respective hanging member being fixed between said major and minor parts, said major and minor parts being held together with a screw, each said major and minor parts having outer surfaces which together define the periphery of said winding drum.

5. The shutter assembly according to claim 1, wherein said leading member of the shutter curtain contacts with a bottom member located in said roof, and said shutter assembly further comprises a sealing device provided with cushion members provided on at least one of the bottom member and leading member.

6. The shutter assembly according to claim 1, wherein, for each said shutter curtain, a passage slit is provided on an upper surface of said lower container space and a pair of guide pieces having upper and lower edges is provided, one guide piece on each side of said passage slit, the lower edges of which being more widely spaced than said upper edges to guide said shutter curtain.

7. The shutter assembly according to claim 6, wherein said bay window has an outwardly directed sash at the bottom of said window portion, and said leading member of said shutter curtain has a top horizonal plate which covers said passage slit when said shutter curtain is in an open position and provides a water flashing function, said horizontal plate including a soft elastic tongue piece attached thereto to contact with said window sash.

8. The shutter assembly of claim 1, including a housing case for each winding drum, wherein each said winding drum is partially enclosed within its housing case, said housing case acting as a supporting member for said driving shaft, each housing case having two sides parallel to the sides of the winding drum and regulating pins which traverse said two sides of said housing case close to the outer circumference of said window drum, said regulating pins acting to keep said hanging member from slipping off said winding drum.

9. The shutter assembly of claim 1, wherein said roof is provided with an aperture for access to said driving system, said aperture having a cover door.

10. The shutter assembly of claim 1, comprising an access aperture and a covering panel located on the outside of said lower container space for access to the maintenance of the winding shafts, and wherein said guide rails comprise two members having an L-shaped portion, said members having a longer side wall and a shorter end wall, said shorter end walls of said two members being detachably engaged to form a guiding groove for guiding said shutter curtain.

11. The shutter assembly of claim 10, wherein the first of said two members is formed in the corner jamb of said bay window, and the second of said two members engages with the first member to form said guiding groove.

12. The shutter assembly according to claim 11, wherein said second member has a plurality of L-shaped cutouts formed thereon in a row, and said first member has a plurality of engaging members to engage with said cutouts and connect said first and second members into said guide rail.

13. The shutter assembly according to claim 11, wherein said end walls of said guide rail members are connected by means of a coupling member having an engaging plate and a bolt.

14. A shutter assembly in combination with a bay window having multiple protruding sides divided by corner jambs, an upper roof part defining an upper containing space, an intermediate window part, and a bottom lower part defining a lower containing space beneath said window part, said assembly comprising:

a shutter curtain on at least two sides of the bay window for selectively closing off the window on the respective sides thereof, each said shutter curtain having a top leading member and a bottom portion;

an elongate winding shaft for each said shutter curtain located in said lower containing space of the bay window and having a longitudinal axis disposed parallel to the plane of the associated side of the bay window, said bottom portion of each said shutter curtain being fixed to and adapted to be wound about its corresponding winding shaft; and drive means coupled to each said shutter curtain for winding and unwinding said shutter curtain about said winding shaft, whereby each said shutter curtain is moved from an open position to a closed position by activating said drive means in one direction to positively apply a lifting force to the top of said shutter curtain to unwind said curtain from said winding shaft thereby causing said curtain to be raised, and whereby said shutter curtain is moved from a closed position to an open position by activating said drive means in a reverse direction opposite said one direction and positively wind said curtain onto said winding shaft thereby causing said curtain to be lowered; and wherein the axes of adjacent of adjacent winding shafts are vertically offset so as to position an end of one winding shaft overlying an end of the adjacent winding shaft at a corner joint of the bay window without interference between the two winding shaft ends.

15. The shutter assembly as claimed in claim 14, wherein:

each said drive means comprises:

spring means contained within said winding shaft for biasing said winding shaft in one rotational direction, said bottom portion of said shutter curtain being fixed to and adapted to be wound about said winding shaft; and elongated pulling means having a first end and a second end, said first end connected to said top leading member of said shutter curtain for pulling said top leading member upwardly; and wherein said shutter assembly further includes motor means, disposed in said upper containing space, coupled to each of said second ends of said pulling means, whereby said shutter curtains are moved from an open position to a closed position by activating said motor means in one direction to pull on said second ends of said pulling means and lift said leading members upwardly, causing said curtains to be raised against the bias of said spring means, said curtains being moved from a closed to an open position by reversing the direction of activation of said motor means thereby enabling said leading members to move down and allow said curtains to be lowered and be wound on said winding shafts under the influence of said spring means.

* * * * *